US011037421B2

(12) United States Patent
Zhang

(10) Patent No.: US 11,037,421 B2
(45) **Date of Patent: *Jun. 15, 2021**

(54) BOX EDGE SECURITY DEVICE

(71) Applicant: Edge Security Products, LLC, Waxhaw, NC (US)

(72) Inventor: Ningsheng Zhang, Waxhaw, NC (US)

(73) Assignee: EDGE SECURITY PRODUCTS, LLC, Waxhaw, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/804,708

(22) Filed: Feb. 28, 2020

(65) Prior Publication Data

US 2020/0202691 A1 Jun. 25, 2020

Related U.S. Application Data

(63) Continuation of application No. 15/944,283, filed on Apr. 3, 2018, now Pat. No. 10,593,178, which is a continuation of application No. 15/268,109, filed on Sep. 16, 2016, now Pat. No. 9,934,665.

(51) Int. Cl.

| | |
|---|---|
| ***G08B 13/24*** | (2006.01) |
| ***E05B 73/00*** | (2006.01) |
| ***G08B 13/14*** | (2006.01) |
| ***G08B 25/10*** | (2006.01) |

(52) U.S. Cl.

CPC ..... *G08B 13/2434* (2013.01); *E05B 73/0029* (2013.01); *G08B 13/1463* (2013.01); *G08B 25/10* (2013.01)

(58) Field of Classification Search

CPC ..... G08B 13/2434; G08B 13/1463; G08B 25/10; E05B 73/0029

USPC ..... 340/572.9

See application file for complete search history.

(56) References Cited

U.S. PATENT DOCUMENTS

| | | | | |
|---|---|---|---|---|
| 5,578,991 | A | 11/1996 | Scholder | |
| 5,617,073 | A * | 4/1997 | Wilson | G08B 13/1463 340/568.2 |
| 5,748,083 | A | 5/1998 | Rietkerk | |
| 5,794,464 | A | 8/1998 | Yeager et al. | |
| 5,955,951 | A | 9/1999 | Wischerop et al. | |
| 6,092,401 | A | 7/2000 | Sankey et al. | |
| 6,237,375 | B1 | 5/2001 | Wymer | |
| 7,084,740 | B2 | 8/2006 | Bridgelall | |
| 7,183,920 | B2 | 2/2007 | Napolitano | |
| 7,251,966 | B2 | 8/2007 | Fawcett | |
| 7,659,817 | B2 | 2/2010 | Conti et al. | |
| 7,963,131 | B2 | 6/2011 | Zhang et al. | |
| 8,004,406 | B2 * | 8/2011 | Bleckmann | G08B 13/2434 340/568.1 |
| 8,305,219 | B2 | 11/2012 | Yang | |
| 8,368,537 | B2 | 2/2013 | Zhang et al. | |
| 8,499,595 | B2 | 8/2013 | Zhang et al. | |
| 8,525,675 | B2 | 9/2013 | Zhang et al. | |
| 8,773,267 | B2 | 7/2014 | Conti et al. | |
| 8,887,541 | B2 | 11/2014 | Zhang et al. | |

(Continued)

*Primary Examiner* — John A Tweel, Jr.
(74) *Attorney, Agent, or Firm* — Burr & Forman, LLP

(57) ABSTRACT

A security device is provided that includes a seal and a tag assembly. The seal may be configured to be attached to a merchandise box. The tag assembly may include housing and an electronics assembly disposed within the housing. The housing of the tag assembly may be configured to slide onto the seal via sliding engagement between the housing and the seal.

18 Claims, 24 Drawing Sheets

(56) References Cited

U.S. PATENT DOCUMENTS

| | | | | |
|---|---|---|---|---|
| 9,179,670 | B2 * | 11/2015 | Czarnik | A01N 43/08 |
| 9,206,628 | B2 | 12/2015 | Zhang et al. | |
| 9,234,371 | B2 | 1/2016 | Conti et al. | |
| 9,404,291 | B1 * | 8/2016 | White | E05B 73/0017 |
| 10,121,340 | B2 * | 11/2018 | Yang | G08B 13/2434 |
| 10,529,207 | B1 * | 1/2020 | Yang | E05B 73/0029 |
| 10,593,178 | B2 * | 3/2020 | Zhang | G08B 25/10 |
| 2004/0066296 | A1 | 4/2004 | Atherton | |
| 2007/0029385 | A1 | 2/2007 | Kovac | |
| 2008/0316028 | A1 | 12/2008 | Conti et al. | |
| 2009/0057244 | A1 | 3/2009 | Conti et al. | |
| 2009/0079566 | A1 | 3/2009 | Goldstein et al. | |
| 2009/0095695 | A1 | 4/2009 | Moock et al. | |
| 2009/0223260 | A1 | 9/2009 | Conti et al. | |
| 2010/0315239 | A1 | 12/2010 | Yang | |
| 2011/0100992 | A1 | 5/2011 | Zhang et al. | |
| 2011/0285507 | A1 | 11/2011 | Nelson | |
| 2013/0169440 | A1 | 7/2013 | Bruhwiler et al. | |
| 2014/0191870 | A1 | 7/2014 | Valiulis | |
| 2015/0077256 | A1 | 3/2015 | Maddox | |

* cited by examiner

140

BOX EDGE SECURITY DEVICE

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

Field of the Present Invention

The present invention relates generally to security devices used to protect merchandise or other objects, and, in particular, to box edge security devices.

Background

Shoplifting has been a problem in a wide variety of retail and other settings for centuries. In the last few decades, tools and systems have been developed to help combat shoplifting. One common type of system is an electronic article surveillance (EAS) system, which commonly includes EAS tags, a transmitter, a receiver, and an alarm system. Tags are attached to respective merchandise items, while the transmitter and receiver are generally located at or near the exit of the retail location being protected such that individuals leaving the store must pass through the area of the transmitter and receiver on their way out. In a typical system, the transmitter transmits signals through a detection zone. When an EAS tag enters the zone, the tag responds and creates a signal or a change or disturbance in the original signal transmitted by the transmitter, and the result is detected by the receiver. The receiver reports this result to the alarm system so that further action can be taken. For example, an audible alarm may sound such that store personnel can be made aware that someone is trying to leave the store with an active EAS tag. Because tags are typically removed or deactivated by a cashier at point of sale, the alarm may thus be interpreted to mean that the individual is carrying a merchandise item which may not have been paid for.

It will be appreciated that in such a system, it is the EAS tag that is being detected by the transmitter/receiver and not the actual merchandise itself. Thus, an EAS system can be circumvented by removing the EAS tag from the merchandise item, which therefore makes it important to provide physical tags that are difficult to remove. Tags are thus typically housed in some sort of device that also serves the function of attaching the tag to the merchandise in a manner makes it more difficult for a shoplifter to tamper with or otherwise remove the EAS tag from the merchandise.

One known type of device is a cable wrap security device. Examples of this type of device are disclosed in U.S. Pat. Nos. 7,497,101 and 9,234,371. This type of security device commonly includes a housing for a ratchet mechanism, a separate housing for an EAS tag, and a cable that is routed through both the two housings and wrapped around the merchandise. The ratchet mechanism is used to tighten the cable around the merchandise such that the security device is not removable from the merchandise without being released and loosened. The device further includes a locking mechanism that prevents releasing the cable without a specifically configured key or other specialized equipment that is generally only accessible to authorized personnel of the store or other retail establishment. In some applications, the cable of the cable wrap security device also prevents a potential shoplifter from opening or otherwise tampering with the packaging containing the merchandise in an attempt to access the merchandise within the packaging.

Unfortunately, cable wrap security devices, while possibly suitable for their intended purposes, may not be ideal for the protection of all types of merchandise items. For example, merchandise items in the form of openable boxes may sometimes still be opened, using varying amounts of force, to access the contents thereof. Although cable wrap security devices may prevent this to some degree, the cables do not always prevent such boxes from being opened and their contents accessed and even removed, thus rendering such cable wrap security devices useless. Furthermore, cable wrap security devices are not suitable for some package geometries, such as long, narrow boxes, because it is possible to manipulate the cables relative to the boxes until they can be removed entirely. In addition, cable wrap security devices are typically expensive and not easy to use. A significant portion of this high cost is due to the cables themselves. Use of the devices generally requires the cables to be unwound and rewound, which is tedious and time-consuming; if the cables are not rewound, the cables tend to get tangled, rendering the devices inoperable. Still further, it is highly inconvenient to stack multiple packages with cable wrap security devices installed thereon because of the way the thick housings of such devices are disposed in the middle of the packages.

Therefore, a need exists for improved merchandise security devices that can be used to reliably prevent openable merchandise boxes from being opened.

SUMMARY OF THE PRESENT INVENTION

Some exemplary embodiments of the present invention may overcome one or more of the above disadvantages and other disadvantages not described above, but the present invention is not required to overcome any particular disadvantage described above, and some exemplary embodiments of the present invention may not overcome any of the disadvantages described above.

According to some example embodiments, a security device is provided that includes a seal and a tag assembly. The seal may be configured to be attached to a merchandise box. The tag assembly may include housing and an electronics assembly disposed within the housing. The housing of the tag assembly may be configured to slide onto the seal via sliding engagement between the housing and the seal.

According to some example embodiments, another security device is provided. The security device may comprise a seal configured to be attached to a merchandise box. The seal may comprise a first structural portion and a seal recessed groove. An underside surface of the first structural portion may be disposed on an opposite side of the first structural portion from the outer surface. The underside surface of the first structural portion may be configured to be affixed to a first surface of the merchandise box. The security device may also comprise a tag assembly comprising a housing and an electronics assembly disposed within the housing. The housing may comprise a tag assembly recessed groove. The housing of the tag assembly may be configured to slide onto the seal via sliding engagement between the tag assembly recessed groove and the seal recessed groove to couple the tag assembly to the seal. The sliding engagement between the housing of the tag assembly and the seal aligns locking features of the tag assembly and the seal to cause a locked engagement between the housing of the tag assembly and the seal.

According to some example embodiments, another security device is provided. The security device may comprise a seal configured to be attached to a merchandise box. The seal may comprise a seal recessed groove and a plunger aperture. The security device may also comprise a tag assembly comprising a housing, an electronics assembly disposed within the housing, and a box sensor. The housing may comprise a tag assembly recessed groove. The housing of the tag assembly may be configured to slide onto the seal via sliding engagement between the tag assembly recessed groove and the seal recessed groove to couple the tag assembly to the seal. The box sensor may comprise a spring-loaded plunger. The sliding engagement between the housing of the tag assembly and the seal aligns the spring-loaded plunger with the plunger aperture to permit the spring-loaded plunger to pass through the plunger aperture and contact the merchandise box to detect a presence of the merchandise box.

According to some example embodiments, another security device is provided. The security device may comprise a seal configured to be attached to a merchandise box. The seal may comprise a seal recessed groove. The tag assembly may comprise a housing comprising a tag assembly recessed groove. The tag assembly may further comprise a communications element, disposed within the housing, configured to wirelessly transmit to a remote device. The housing of the tag assembly may be configured to slide onto the seal via sliding engagement between the tag assembly recessed groove and the seal recessed groove to couple the tag assembly to the seal.

Broadly defined, one aspect is a box edge security device, for merchandise, that contains an electronics assembly, all according to at least one embodiment shown and/or described herein.

In a feature of this aspect, the electronics assembly is an electronic article surveillance (EAS) tag.

Broadly defined, another aspect is a box edge security device, for merchandise, including: an edge seal according to at least one embodiment shown and/or described herein; and a tag assembly, including an electronics assembly, according to at least one embodiment shown and/or described herein that interlocks with the edge seal.

In a feature of this aspect, the electronics assembly is an electronic article surveillance (EAS) tag.

Broadly defined, according to another aspect is a merchandise item protected by a box edge security device that contains an electronics assembly, all according to at least one embodiment shown and/or described herein.

Broadly defined, according to another aspect is a merchandise item protected by a box edge security device, including: a merchandise box; an edge seal according to at least one embodiment shown and/or described herein; and a tag assembly, including an electronics assembly, according to at least one embodiment shown and/or described herein that interlocks with the edge seal.

Broadly defined according to another aspect is a box edge security device, for a merchandise box that includes having adjacent structural portions connected together along an edge, including: an edge seal adapted to be attached around an edge of a merchandise box, the merchandise box having a first structural portion and a second structural portion that are connected to one another along the edge, such that a first portion of the edge seal is disposed against the first structural portion of the merchandise box and a second portion of the edge seal is disposed against the second structural portion of the merchandise box; and a tag assembly that interlocks with the edge seal and includes an electronics assembly, contained within a housing, that forms at least part of an alarm system.

In a feature of this aspect, the electronics assembly includes an electronic article surveillance (EAS) tag.

In another feature of this aspect, the edge seal includes two flat portions arranged at an angle to one another and adapted to fit around the edge of a merchandise box whose first and second structural portions are flat.

In a further feature, the angle is a right angle.

In another further feature, each of the two flat portions includes a box-facing surface, on its underside, to which a pressure-sensitive adhesive (PSA) is applied.

In other further features, the tag assembly includes a housing in which the EAS tag is disposed; the tag assembly includes a lock plug that biased into engagement with the edge seal; the edge seal includes an aperture that engages the lock plug; the tag assembly includes a box sensor that detects the proximity of a merchandise box thereto; and/or the box sensor includes a spring-loaded plunger that extends through an aperture in the edge seal and contacts a surface of the merchandise box.

In other further features, respective interlocking grooves, angled surfaces, or other structures are provided near the periphery of the underside of the tag assembly and on an outwardly-facing surface of one of the two flat portions of the edge seal, respectively, such that the tag assembly may be coupled to the edge seal by sliding the tag assembly onto the edge seal by sliding the respective structure of the tag assembly onto the respective structure of the edge seal; the underside of the tag assembly includes a recessed groove near its periphery, wherein the edge seal includes a profiled edge on the outwardly-facing surface, and wherein the recessed groove of the underside of the tag assembly couples with the profiled edge of the edge seal to interlock the tag assembly to the edge seal; and/or the tag assembly includes a lock plug that biased into engagement with the edge seal such that the once the tag assembly is fully coupled onto the edge seal by sliding the tag assembly onto the edge seal via the respective interlocking structures, the tag assembly cannot be removed from the edge seal until the lock plug is manually disengaged from the edge seal.

In other further features, an outwardly-facing surface of one of the two flat portions of the edge seal includes a flat channel that accommodates a strap around the merchandise box; and/or a raised protuberance is arranged on each side of the flat channel and extends up into a recess in an underside of the tag assembly to prevent the box edge security device from being moved sideways relative to the strap.

In another further feature, the edge seal is electrically conductive and forms a sense loop that is broken if the edge seal is removed from a merchandise item.

In another further feature, the edge seal is initially provided in a flat, unfolded configuration and is bent, folded, creased, or otherwise manipulated to fit around the edge of the merchandise box.

In another feature of this aspect, the electronics assembly includes a user-perceptible alarm, and wherein removal of at least one of the edge seal and the tag assembly from the merchandise box triggers the alarm.

Broadly defined, according to another aspect is a merchandise item protected by a box edge security device, including: a merchandise box having a first structural portion and a second structural portion that are connected to one another along an edge; an edge seal attached around the edge of a merchandise box such that a first portion of the edge seal is disposed against the first structural portion of the merchandise box and a second portion of the edge seal is disposed against the second structural portion of the merchandise box; and a tag assembly that interlocks with the edge seal and includes an electronics assembly, contained within a housing, that forms at least part of an alarm system.

Broadly defined according to another aspect is an electronic article surveillance (EAS) system, including: an edge seal adapted to be attached around an edge of a merchandise box, the merchandise box having a first structural portion and a second structural portion that are connected to one another along the edge, such that a first portion of the edge seal is disposed against the first structural portion of the merchandise box and a second portion of the edge seal is disposed against the second structural portion of the merchandise box; a tag assembly that interlocks with the edge seal and includes an electronic article surveillance (EAS) tag contained within a housing; and a surveillance gate that detects the presence of the EAS tag when the EAS tag enters a detection zone.

Broadly defined, according to another aspect is a merchandise item protected by any of the foregoing box edge security devices.

Broadly defined, according to another aspect is an EAS system using any of the foregoing box edge security devices.

Further areas of applicability will become apparent from the detailed description provided hereinafter. It should be understood that the detailed description and specific examples, while indicating the preferred embodiment of the invention, are intended for purposes of illustration only and are not intended to limit the scope.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
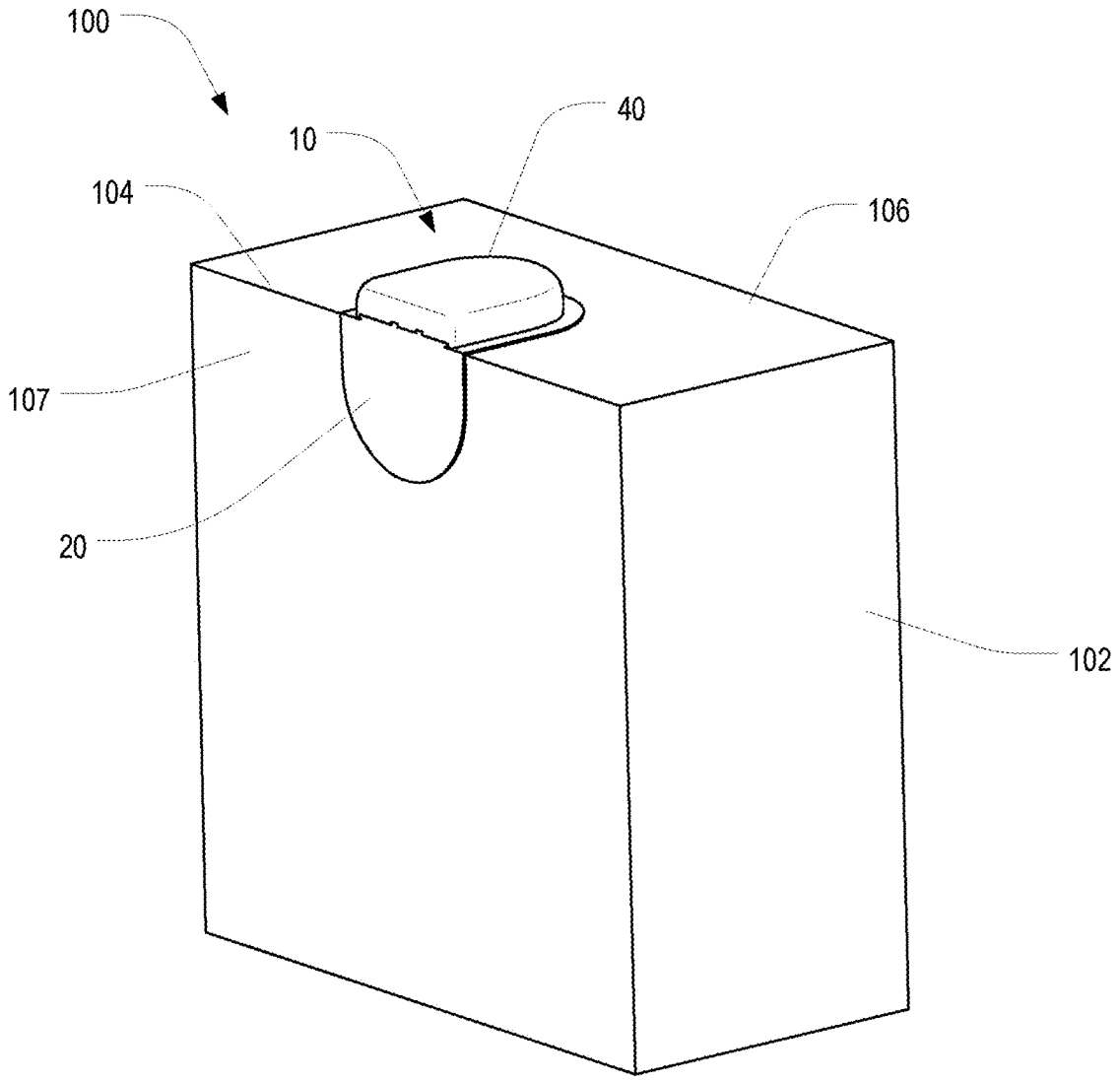
FIG. 1 is an orthogonal view of a merchandise item protected by a box edge security device in accordance with one or more preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. .sctn. 112, 6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

FIG. 1 is an orthogonal view of a merchandise item 100 protected by a box edge security device 10 in accordance with one or more preferred embodiments of the present invention. As shown therein, the merchandise item 100 is packaged in a box 102 having an openable edge 104. As used herein, the term "openable edge" refers to an edge of a box or similar object, where a tab, fold, or the like is arranged to meet another portion of the box to provide at least partial enclosure thereof, but which may be separated from such box portion, without damaging the overall integrity of the box, so as to enable the box to be opened. In some embodiments, the openable edge may be sealed or otherwise affixed to such box portion, while in other embodiments the openable edge is inserted into the box portion without being sealed or otherwise affixed thereto.

Figure 2:
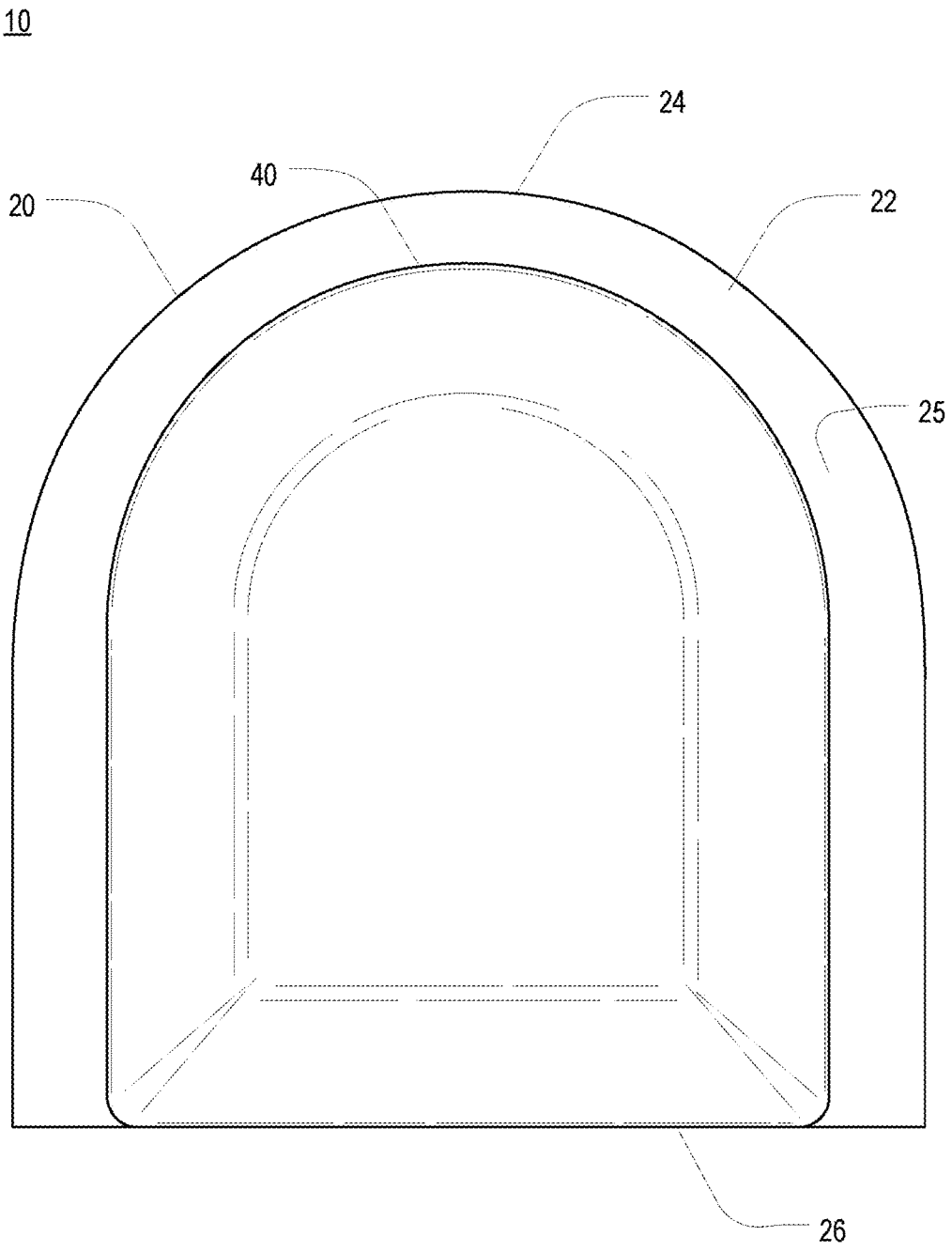
FIG. 2 is a top view of the box edge security device of FIG. 1.

FIG. 2 is a top view, respectively, of the box edge security device 10 of FIG. 1. As shown therein, the box edge security device 10 includes an edge seal 20 and a tag assembly 40.

Figure 3:
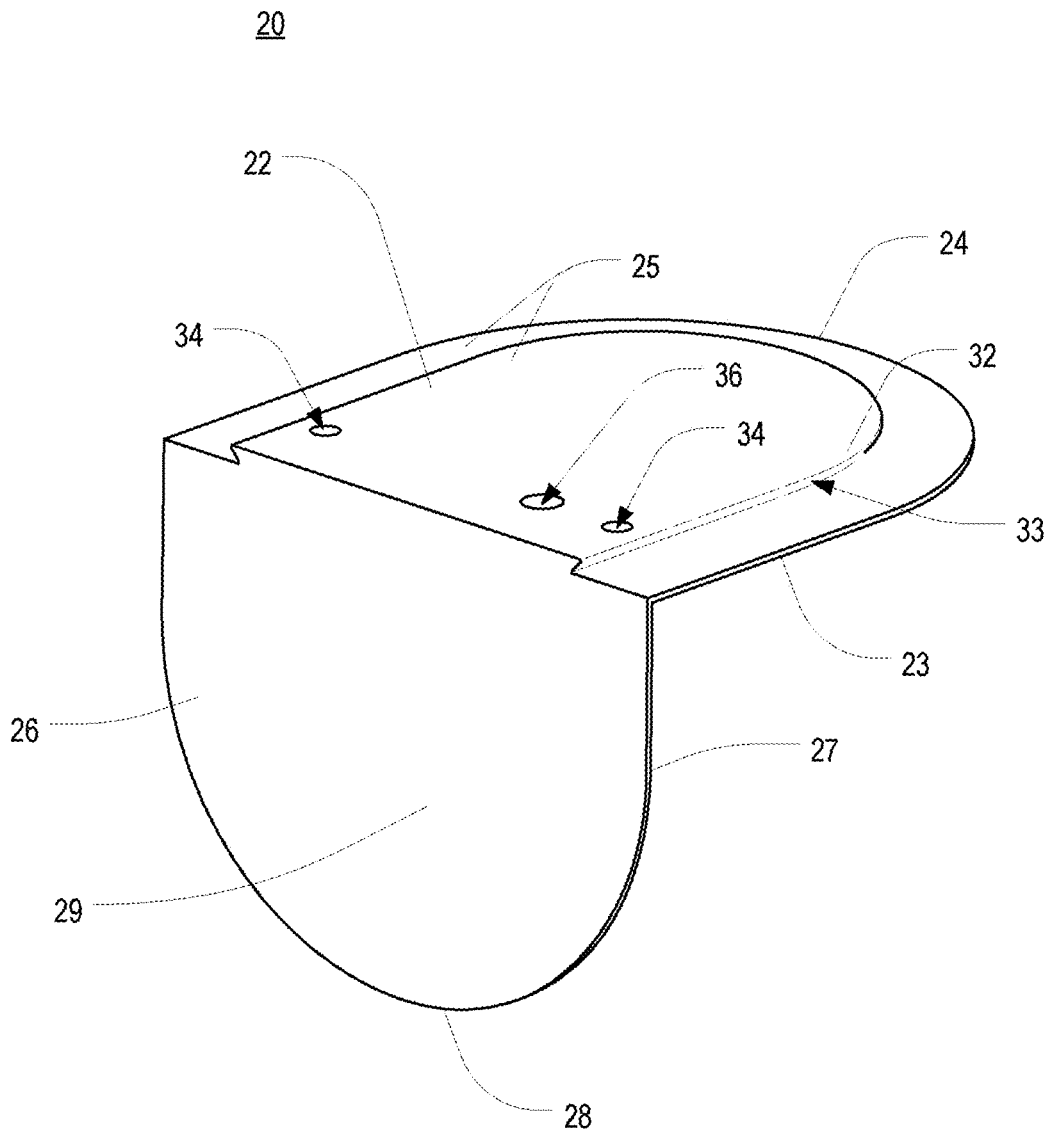
FIG. 3 is an orthogonal view of the exterior of the edge seal of FIG. 2.
Figure 4:
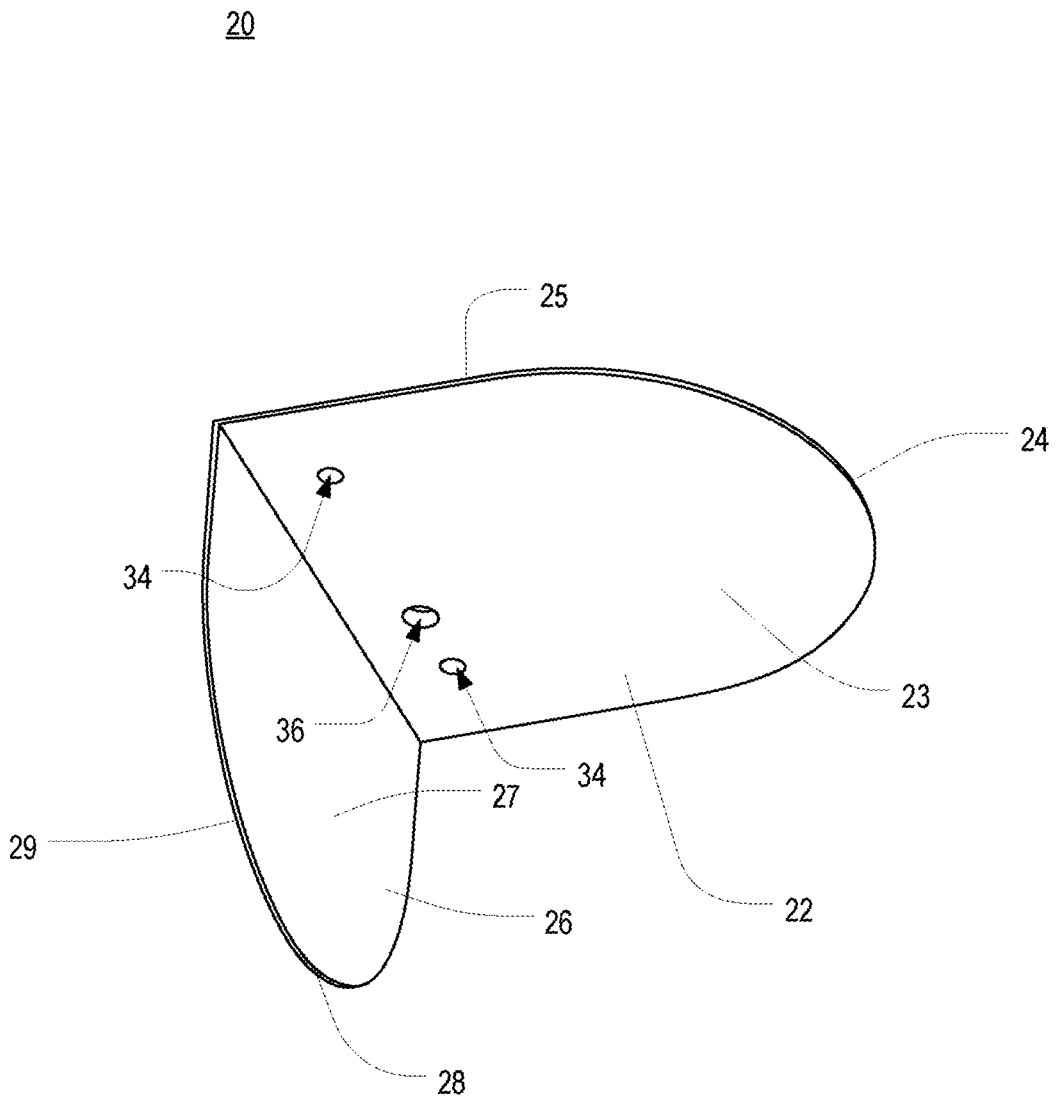
FIG. 4 is an orthogonal view of the underside of the edge seal of FIG. 2.

FIGS. 3 and 4 are orthogonal views of the exterior and the underside, respectively, of the edge seal 20 of FIG. 2. As shown therein, the edge seal 20 includes a first portion 22 and a second portion 26 whose underside surfaces 23,27 are generally flat and are arranged at angles to each other. In most embodiments, the first and second underside surfaces 23,27 may be oriented at right angles to each other so as to fit around the openable edge of a box whose adjacent faces meet at right angles to each other, but the first and second underside surfaces 23,27 may be oriented at other angles relative to one another, particularly for specialized boxes whose adjacent faces meet at such other angles. The first and second portions 22,26 are formed or otherwise manufactured integrally, preferably via injection molding or the like, and the joint between them is strong and durable enough to resist being broken, torn, or otherwise separated by hand. The edge seal 20 is preferably made of plastics, such as polyethylene terephthalate (PET) or ABS. In at least one contemplated commercial embodiment, the first portion 22 is approximately 2 mm thick around its periphery but includes thicker areas (as described below), and the second portion 26 is approximately 1 to 2 mm thick.

Figure 5:
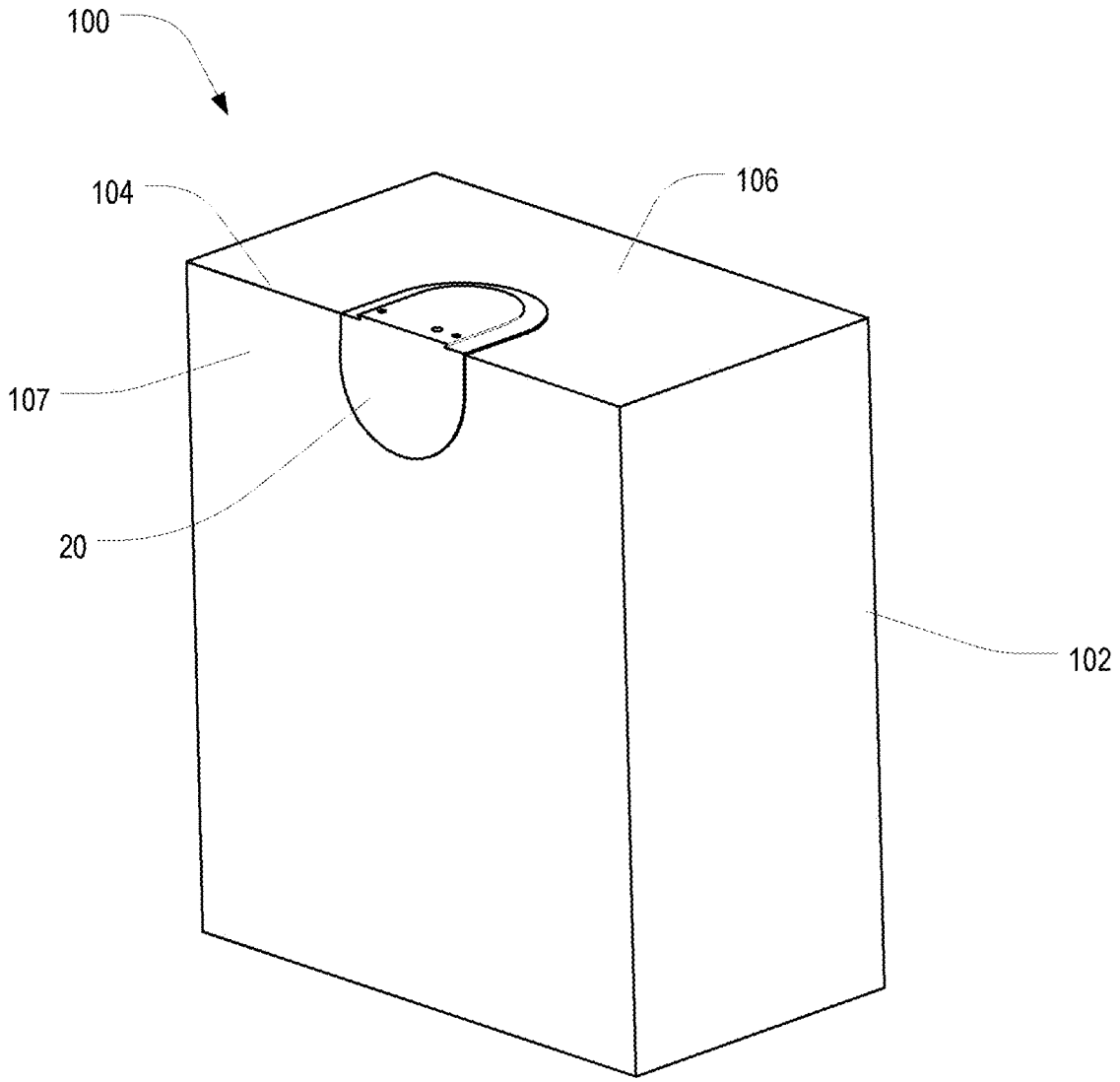
FIG. 5 is an orthogonal view of the merchandise item of FIG. 1 showing the edge seal installed thereon.

The edge seal 20 is well-suited to be attached to the edge of a merchandise box 102 such that the first portion 22 of the seal 20 is placed against one face 106 of the box 102 and the second portion 26 of the seal 20 is placed against an adjoining face 107 of the box 102. More particularly, the seal 20 may be attached to the box 102 by affixing the first and second portions 22,26 of the seal 20 to the adjacent faces 106,107. In this regard, FIG. 5 is an orthogonal view of the merchandise item 100 of FIG. 1 showing the edge seal 20 installed thereon. Attachment may be accomplished, for example, using a pressure-sensitive adhesive (PSA) applied to the underside surfaces 22,27 of the seal, portions of the faces 106,107 of the box 102, or both. By selecting faces 106,107 on either side of an openable edge 104 of the box 102, such edge 104, which would otherwise be openable using conventional methods, becomes sealed against such opening. More particularly, the openable edge 104 may not be opened without compromising the integrity of the box 102, the edge seal 20, or both.

In at least some embodiments, the distal ends 24,28 of the seal portions 22,26 are curved so as to avoid corners that might be more easily pried from the box 102. However, the curvature may vary from that shown in the drawings, and in some embodiments, shapes having vertices may be employed, particularly if their angles are relatively wide (and thus not sharp).

The first portion 22 of the edge seal 20 further includes a tag assembly interface 32, one or more lock apertures 34, and a box sensor aperture 36. In the illustrated embodiment, the tag assembly interface 32 includes a raised profile that is parallel to the underside surface 23 thereof. More particularly, the interface 32 includes an inwardly-angled surface that effectively forms a recessed groove 33 extending around the sides thereof. In the illustrated embodiment, the groove 33 is an angled groove that may be joined to a corresponding structure on the tag assembly 40, by sliding the tag assembly 40 onto the edge seal 20, to form a secure joint. However, other angled joints, tongue and groove joints, and the like may additionally or alternatively be utilized. Furthermore, the disposition of the joints may be reversed; for example, a recessed groove may be provided on the tag assembly, and a corresponding structure may be provided on the edge seal.

In the illustrated embodiment, there are two lock apertures 34. The lock apertures 34 and box sensor aperture 36 are arranged to engage corresponding structures or elements on the tag assembly 40. Their use and operation are at least partially described in a separate section.

Except for the areas of the first portion 22 that interact with the tag assembly 40, the contours of the outer surfaces 25,29 of the first and second portions 22,26 may be somewhat less important than the underside surfaces 23,27 in the sense that they need not been flat, but in at least some embodiments the outer surfaces 25,29 are also flat for the purpose of manufacturing ease and/or some other purpose.

Figure 6:
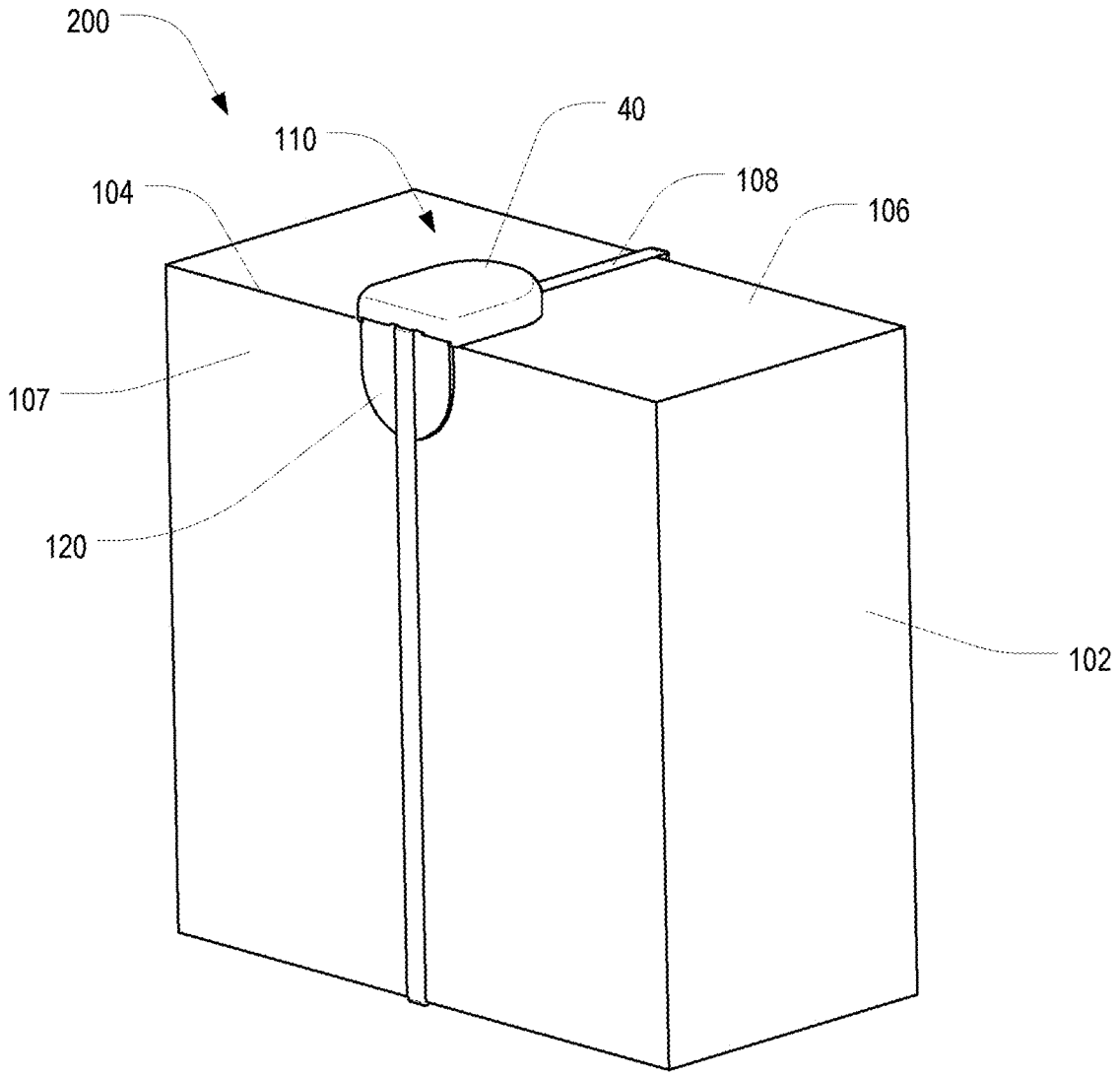
FIG. 6 is an orthogonal view of a merchandise item protected by an alternative box edge security device in accordance with one or more preferred embodiments of the present invention.

FIG. 6 is an orthogonal view of a merchandise item 200 protected by an alternative box edge security device 110 in accordance with one or more preferred embodiments of the present invention. As shown therein, the merchandise item 200 is packaged in a box 102, having an openable edge 104, and around which is wrapped a strap, band, or the like 108 (hereinafter referred to as a "strap"). The box 100 may already be provided with such a strap 108, or a strap 108 may be provided as part of the security device 110. It will be appreciated that although only a single strap 108 is shown in FIG. 6, any number of straps 108 may be utilized according to the preference of the merchandise item manufacturer, packer, shipper, retailer, or the like.

Figure 7:
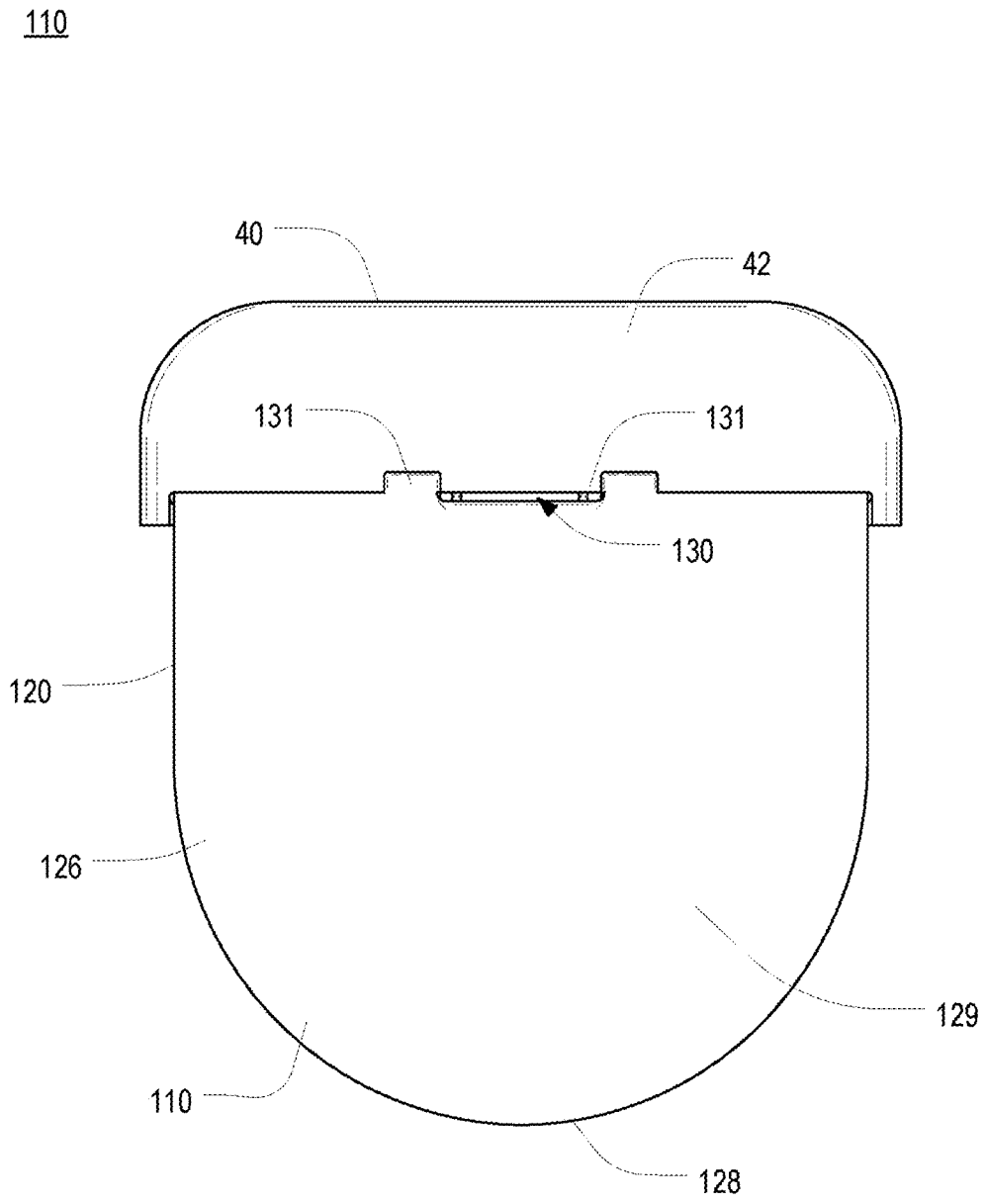
FIG. 7 is a front view of the box edge security device of FIG. 6.
Figure 8:
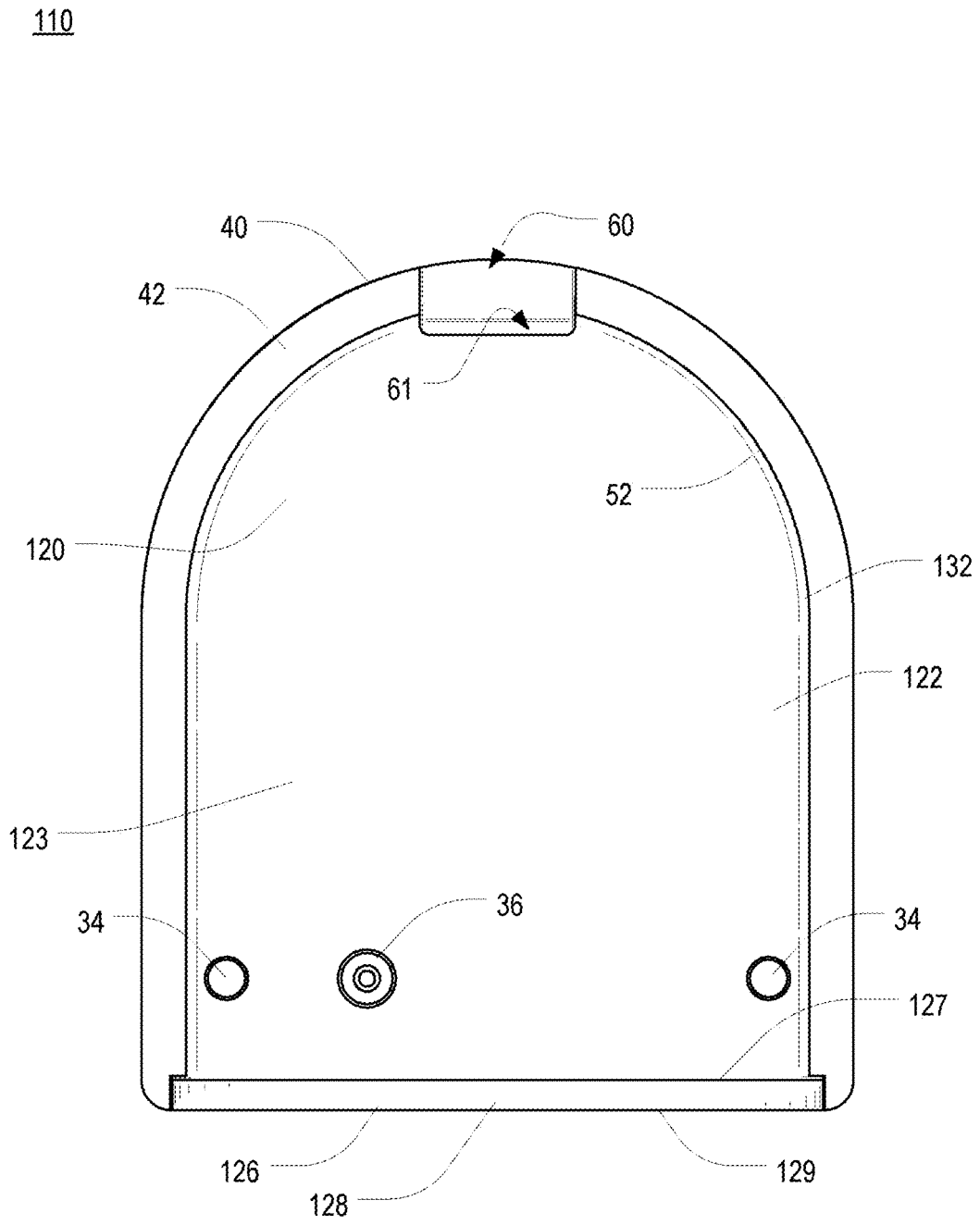
FIG. 8 is a bottom view of the box edge security device of FIG. 6.

FIGS. 7 and 8 are a front view and a bottom view, respectively, of the box edge security device 110 of FIG. 6. As shown therein, the box edge security device 110 includes an edge seal 120 and a tag assembly 40.

Figure 9:
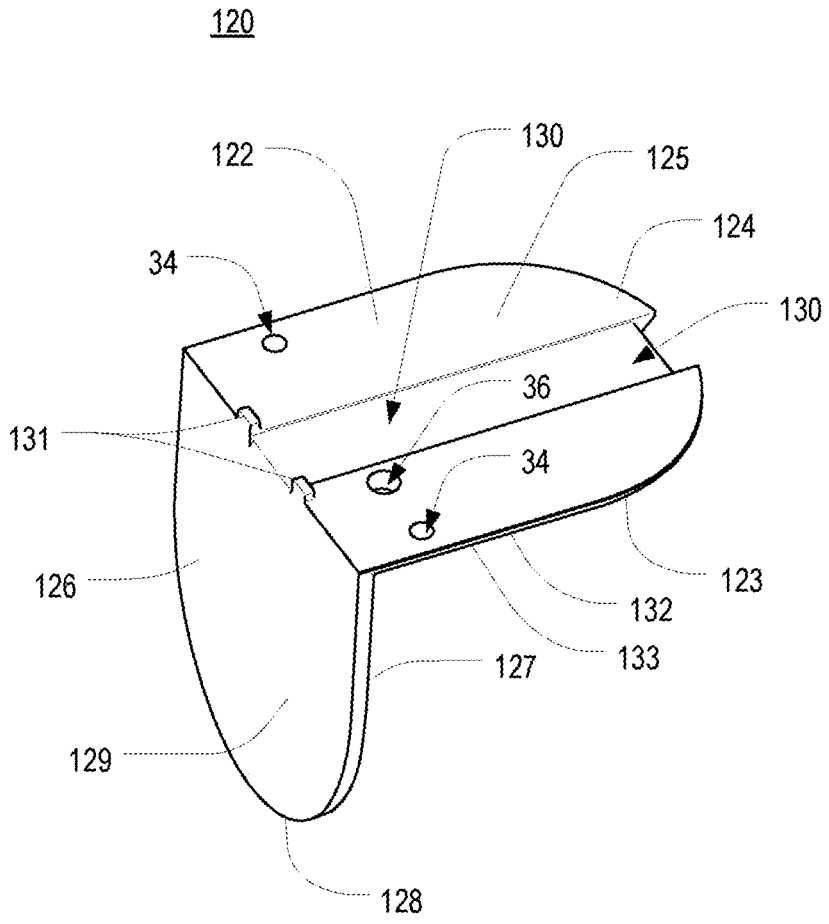
FIG. 9 is an orthogonal view of the exterior of the corner seal of FIGS. 7 and 8.
Figure 10:
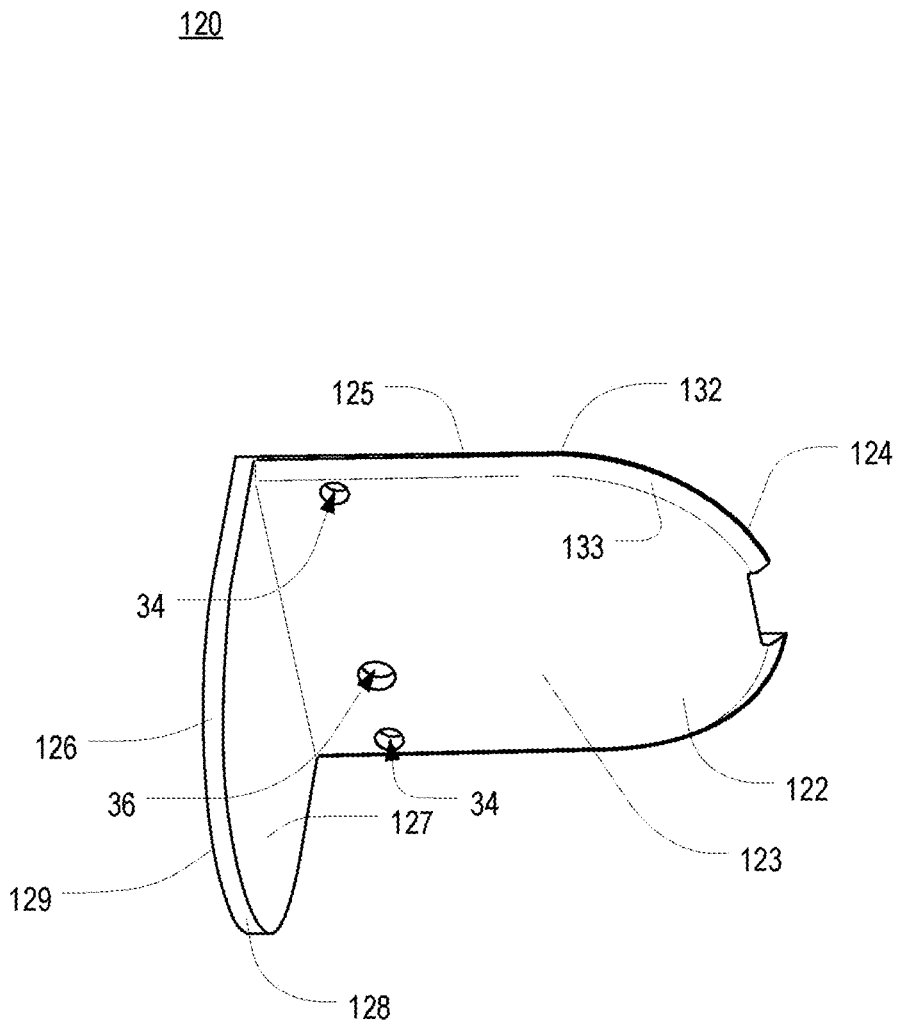
FIG. 10 is an orthogonal view of the underside of the corner seal of FIGS. 7 and 8.
Figure 11:
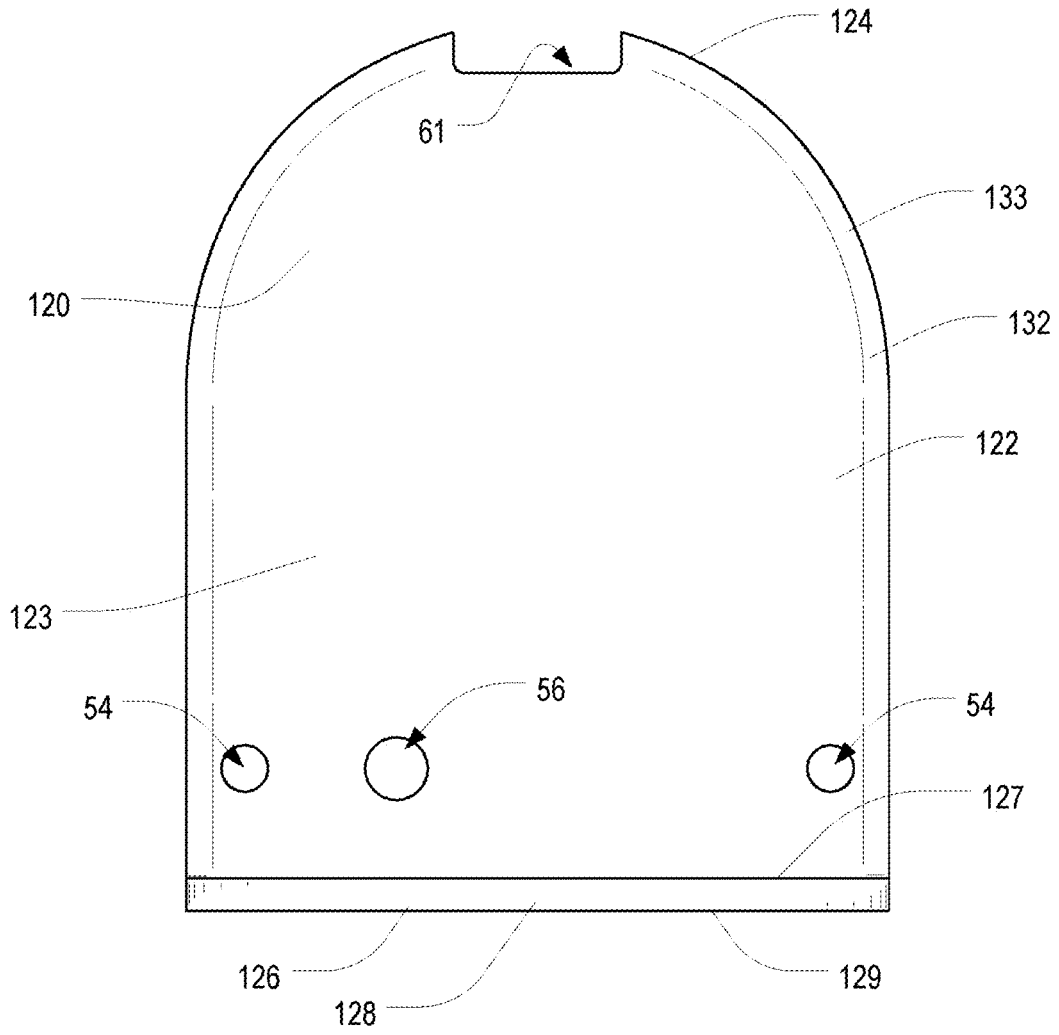
FIG. 11 is a bottom view of the edge seal of FIGS. 7 and 8.

FIGS. 9 and 10 are orthogonal views of the exterior and the underside, respectively, of the edge seal 120 of FIGS. 7 and 8, while FIG. 11 is a bottom view of the edge seal 120 of FIGS. 7 and 8. As shown therein, the edge seal 120 bears many similarities to the edge seal 20 of FIGS. 1-5 and includes a first portion 122 and a second portion 126 whose underside surfaces 123,127 are generally flat and are arranged at angles to each other. In most embodiments, the first and second underside surfaces 123,127 may be oriented at right angles to each other so as to fit around the openable edge of a box whose adjacent faces meet at right angles to each other, but the first and second underside surfaces 123,127 may be oriented at other angles relative to one another, particularly for specialized boxes whose adjacent faces meet at such other angles. The first and second portions 122,126 are formed or otherwise manufactured integrally and the joint between them is strong and durable enough to resist being broken, torn, or otherwise separated by hand. The edge seal 120 is preferably made of plastics, such as polyethylene terephthalate (PET) or ABS. In at least one contemplated commercial embodiment, the first portion 122 is approximately 2 mm thick around its periphery but includes thinner areas (as described below), and the second portion 126 is approximately 1 to 2 mm thick.

Figure 12:
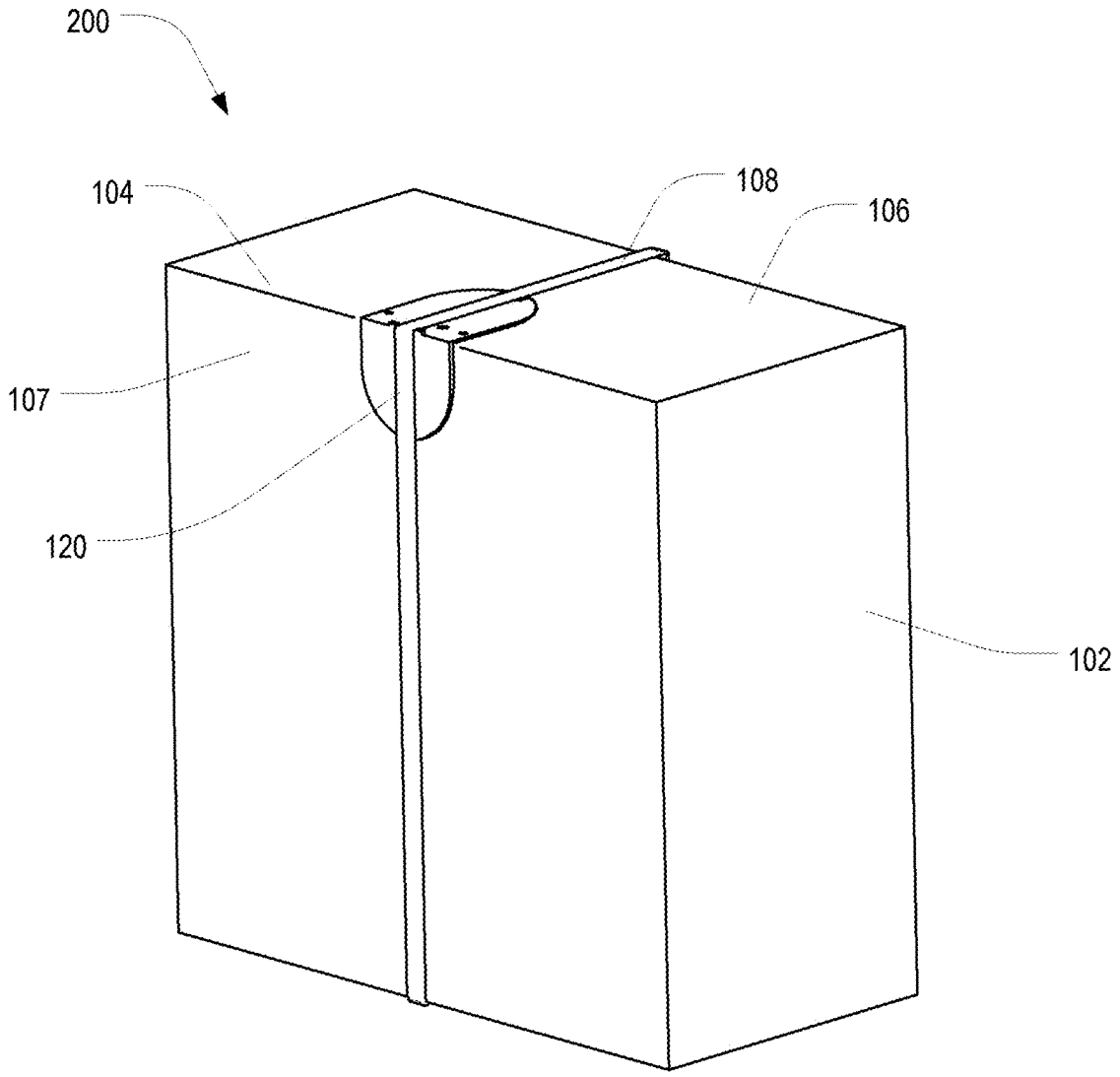
FIG. 12 is an orthogonal view of the merchandise item of FIG. 6 showing the corner seal installed thereon.

Like the edge seal 20 of FIGS. 1-5, the edge seal 120 is well-suited to be attached to the edge of a merchandise box 102 such that the first portion 122 of the seal 120 is placed against one face 106 of the box 102 and the second portion 126 of the seal 120 is placed against an adjoining face 107 of the box 102. More particularly, the seal 120 may be attached to the box 102 via the strap 108. In this regard, FIG. 12 is an orthogonal view of the merchandise item 200 of FIG. 6 showing the edge seal 120 installed thereon. For this purpose, the outer surface 125 of the first portion 122 includes a flat, shallow channel 130 extending from the proximal end (where the first portion 122 joins the second portion 126) to the distal end thereof. The channel 130 is preferably slightly wider and deeper than the width and depth, respectively, of the strap 108 with which the seal 120 is to be used, but it will be appreciated that smaller straps 108 may be utilized without changing the dimensions of the channel 130. One function of the channel 130 is to allow the tag assembly 40 to be coupled to the edge seal 120, with the strap 108 imprisoned in between, without interference from the strap 108. However, it will be appreciated that a channel (not shown) may additionally or alternatively be incorporated into the tag assembly 40, or in some cases the strap 108 may be thin enough that any interference it causes is minimal.

The first portion 122 of the edge seal 120 further includes a pair of retention tabs 131, a tag assembly interface 132, two lock apertures 34, and a box sensor aperture 36. In the illustrated embodiment, the tag assembly interface 132 includes a raised profile that is parallel to the underside surface 123 thereof. More particularly, the interface 132 includes an inwardly-angled surface 133 extending around the sides thereof. In the illustrated embodiment, the angled surface 133 may be joined to a corresponding structure on the tag assembly 40, by sliding the tag assembly 40 onto the edge seal 120, to form a secure joint. However, other angled joints, tongue and groove joints, and the like may additionally or alternatively be utilized. Furthermore, the disposition of the joints may be reversed; for example, an inwardly-angled surface may be provided on the tag assembly, and a corresponding structure may be provided on the edge seal.

In the illustrated embodiment, the alignment tabs 131 are raised protuberances that extend up into corresponding recesses (described below) in the tag assembly 40 in order to prevent the edge seal 120 from being removed from the strap 108. However, the retention tabs 131 may also help guide a strap 108 into place in the channel 130, guide the tag assembly 40 into place on the edge seal 120, and/or carry out some other function. Further, it will be appreciated that a wide variety of other structures may be utilized.

In the illustrated embodiment, there are two lock apertures 34. The lock apertures 34 and box sensor aperture 36 are arranged to engage corresponding structures or elements on the tag assembly 40. Their use and operation are at least partially described in a separate section.

In at least some embodiments, the seal 120 is held in place on an edge 104 of the box 102 by the tension of the strap 108 around the box and/or by virtue of being clamped around the strap 108. However, the seal 120 may be additionally or alternatively attached to the box 102 by affixing the first and second portions 122,126 of the seal 120 to the adjacent faces 106,107. This may be accomplished, for example, using a pressure-sensitive adhesive (PSA) applied to the underside surfaces 122,127 of the seal, portions of the faces 106,107 of the box 102, or both. By selecting faces 106,107 on either side of an openable edge 104 of the box 102, such edge 104, which would otherwise be openable using conventional methods, becomes sealed against such opening. More particularly, the openable edge 104 may not be opened without compromising the integrity of the box 102, the edge seal 120, or both.

In at least some embodiments, the distal ends 124,128 of the seal portions 122,126 are curved so as to avoid corners that might be more easily pried from the box 102 and/or for some other purpose. However, the curvature may vary from that shown in the drawings, and in some embodiments, shapes having vertices may be employed, particularly if their angles are relatively wide (and thus not sharp).

Except for the areas of the first portion 122 that interact with the tag assembly 40, the contours of the outer surfaces 125,129 of the first and second portions 122,126 may be somewhat less important than the underside surfaces 123, 127 in the sense that they need not been flat, but in at least some embodiments the outer surfaces 125,129 are also flat for the purpose of manufacturing ease and/or some other purpose.

Figure 13:
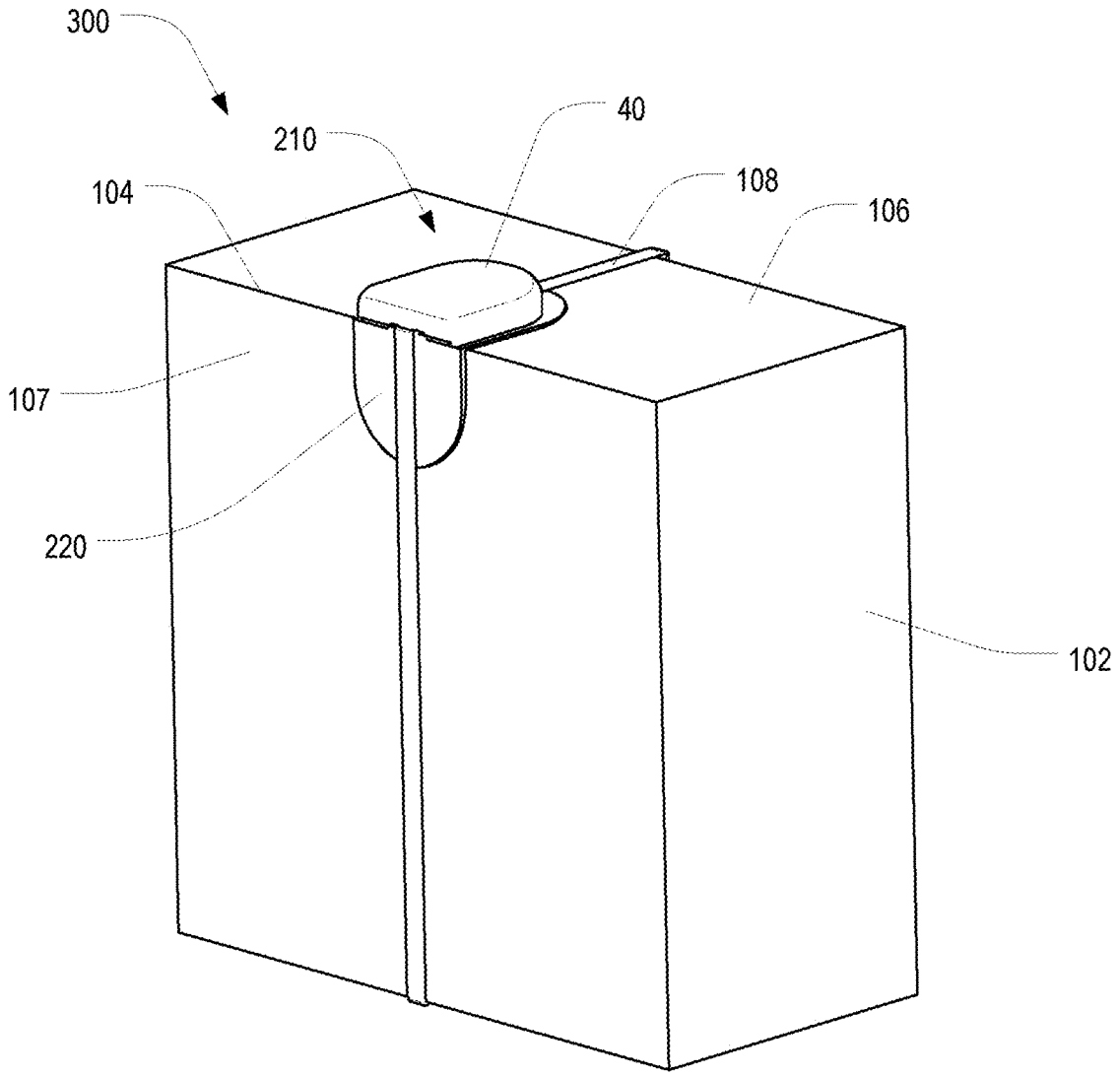
FIG. 13 is an orthogonal view of a merchandise item protected by an another alternative box edge security device in accordance with one or more preferred embodiments of the present invention.

FIG. 13 is an orthogonal view of a merchandise item 300 protected by another alternative box edge security device 210 in accordance with one or more preferred embodiments of the present invention. As shown therein, the merchandise item 300 is packaged in a box 102, having an openable edge 104, and around which is wrapped a strap 108. The box 102 may already be provided with such a strap 108, or a strap 108 may be provided as part of the security device 210. It will be appreciated that although only a single strap 108 is shown in FIG. 6, any number of straps 108 may be utilized according to the preference of the merchandise item manufacturer, packer, shipper, retailer, or the like.

Figure 14:
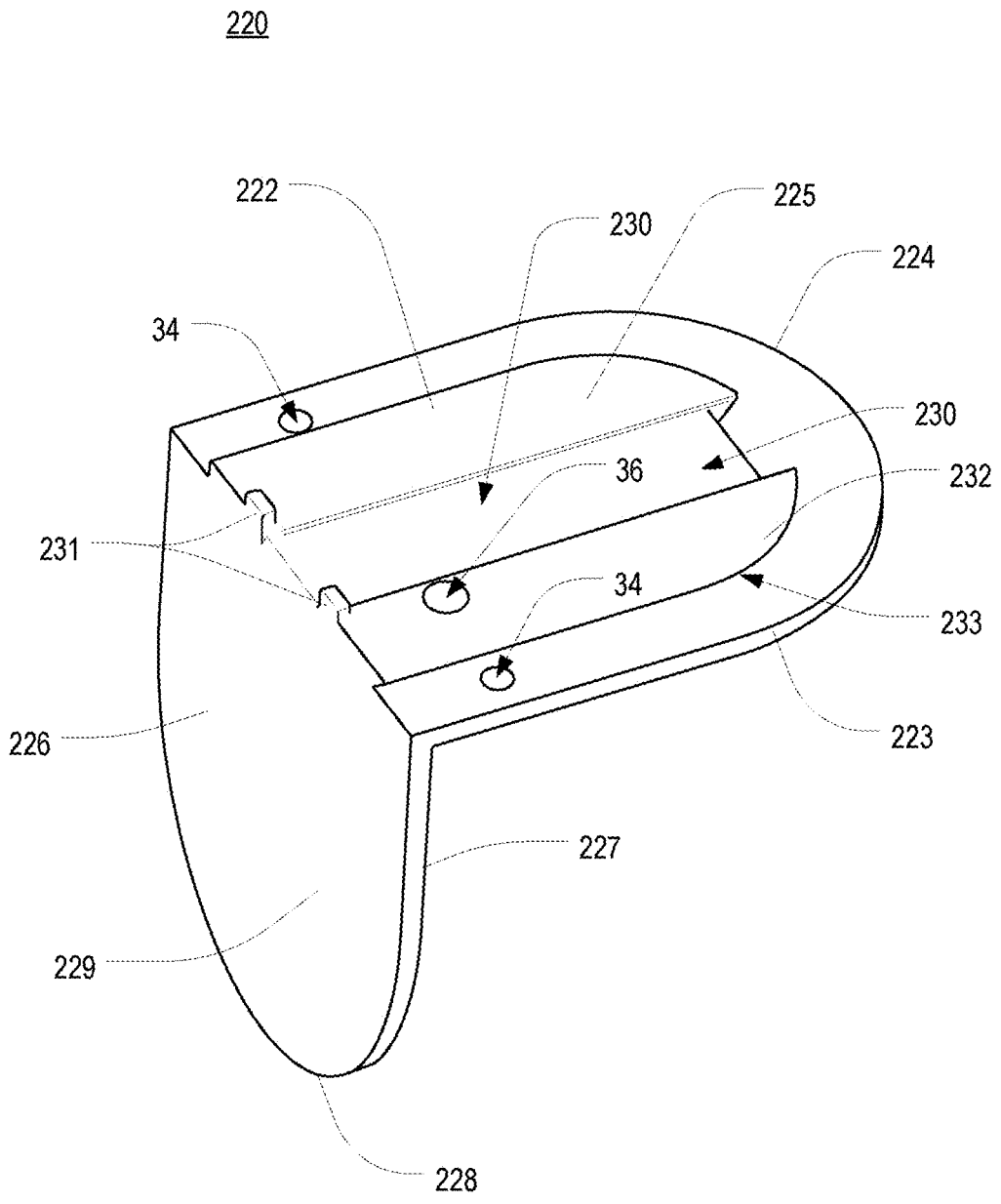
FIG. 14 is an orthogonal view of the exterior of the edge seal of FIG. 13.
Figure 15:
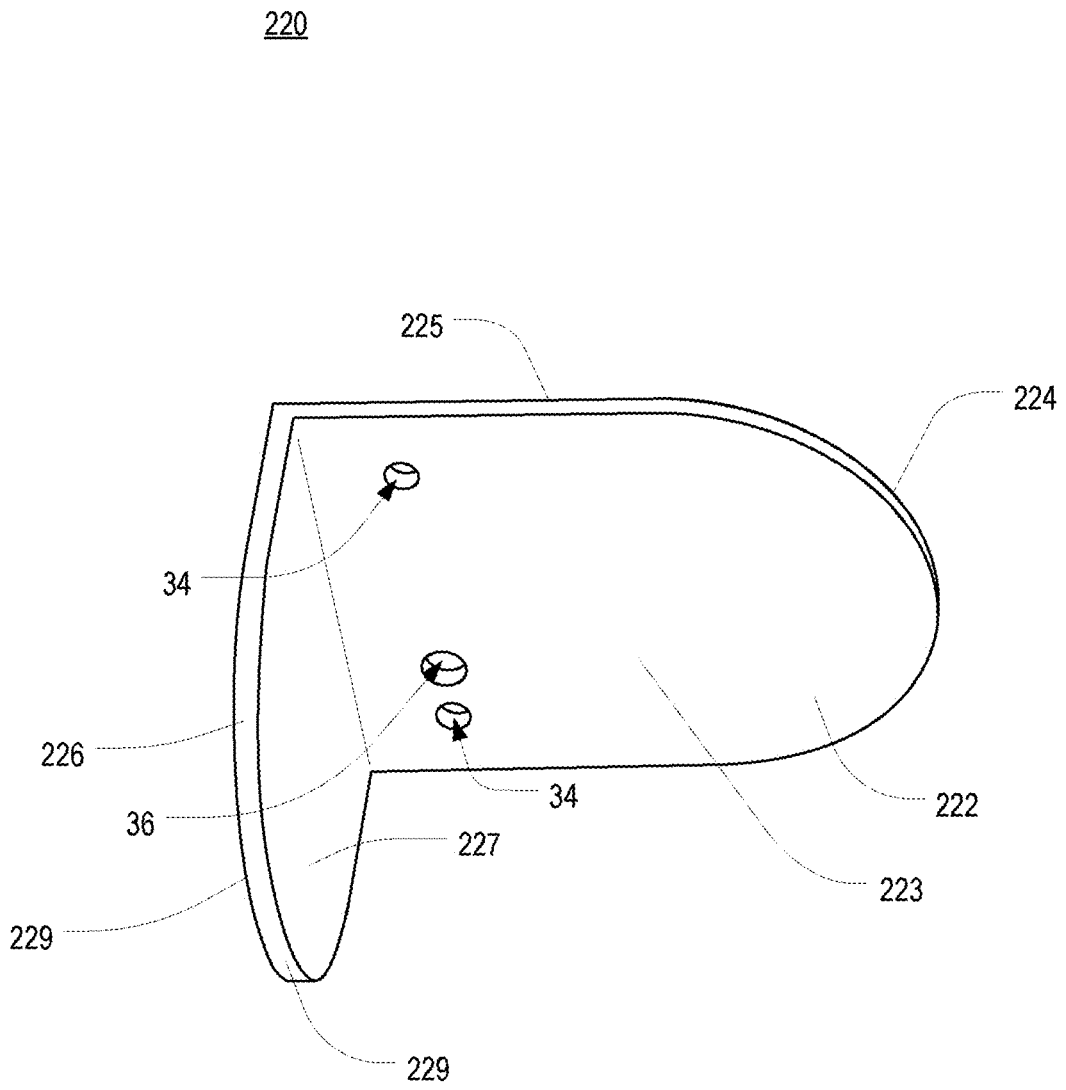
FIG. 15 is an orthogonal view of the underside of the edge seal of FIG. 13.

The box edge security device 210 includes an edge seal 220 and a tag assembly 40. FIGS. 14 and 15 are orthogonal views of the exterior and the underside, respectively, of the edge seal 220 of FIG. 13. As shown therein, the edge seal 220 bears many similarities to the edge seal 20 of FIGS. 1-5 and to the edge seal 120 of FIGS. 6-12 and includes a first portion 222 and a second portion 226 whose underside surfaces 223,227 are generally flat and are arranged at angles to each other. In most embodiments, the first and second underside surfaces 223,227 may be oriented at right angles to each other so as to fit around the openable edge of a box whose adjacent faces meet at right angles to each other, but the first and second underside surfaces 223,227 may be oriented at other angles relative to one another, particularly for specialized boxes whose adjacent faces meet at such other angles. The first and second portions 222,226 are formed or otherwise manufactured integrally and the joint between them is strong and durable enough to resist being broken, torn, or otherwise separated by hand. The edge seal 220 is preferably made of plastics, such as polyethylene terephthalate (PET) or ABS. In at least one contemplated commercial embodiment, the first portion 222 is approximately 2 mm thick around its periphery but includes thinner areas (as described below), and the second portion 226 is approximately 1 to 2 mm thick.

Figure 16:
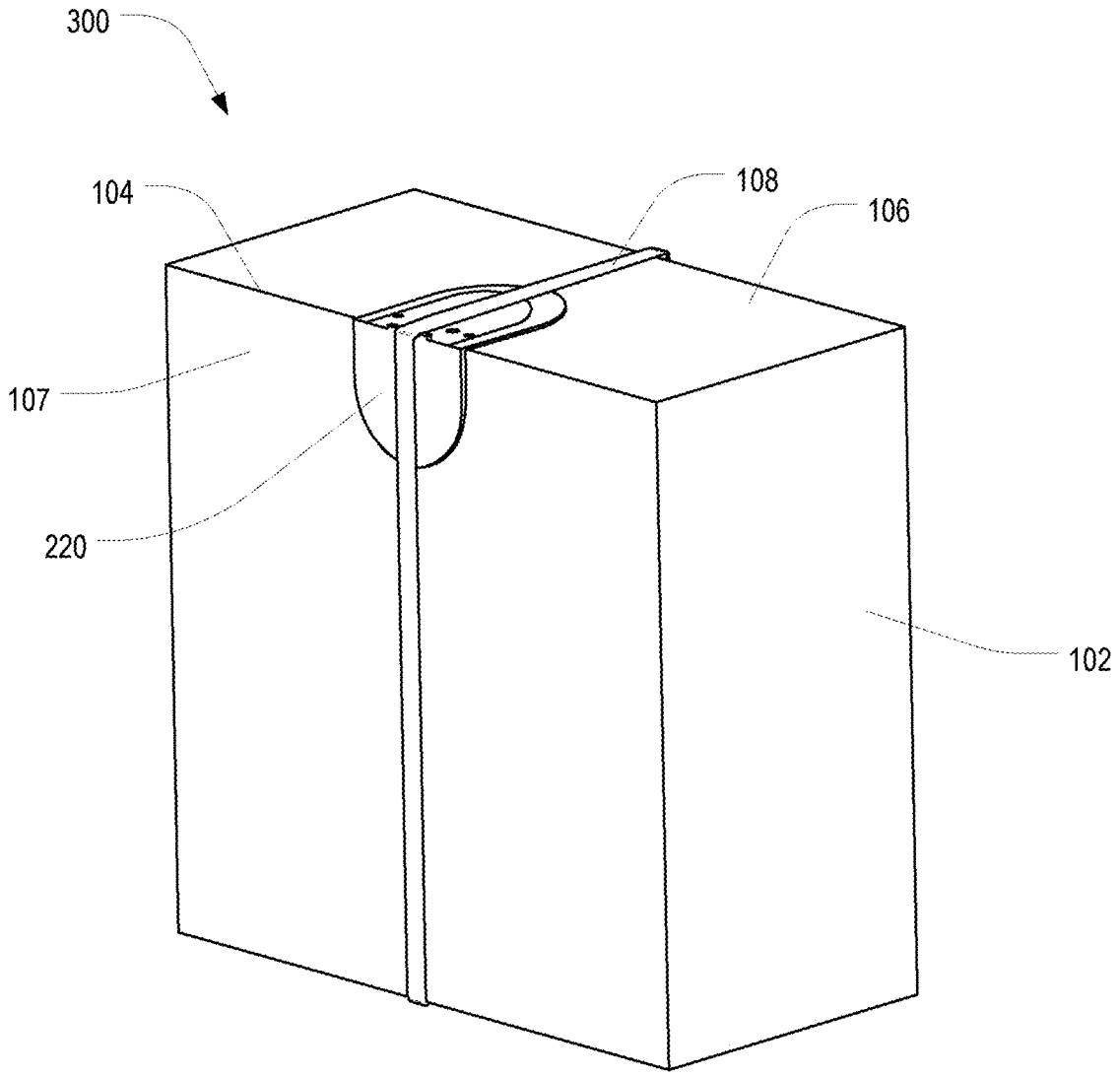
FIG. 16 is an orthogonal view of the merchandise item of FIG. 13 showing the edge seal installed thereon.

Like the edge seal 20 of FIGS. 1-5 and the edge seal 120 of FIGS. 6-12, the edge seal 220 is well-suited to be attached to the edge of a merchandise box 102 such that the first portion 222 of the seal 220 is placed against one face 106 of the box 102 and the second portion 226 of the seal 220 is placed against an adjoining face 107 of the box 102. More particularly, the seal 220 may be attached to the box 102 via the strap 108. In this regard, FIG. 16 is an orthogonal view of the merchandise item 300 of FIG. 13 showing the edge seal 220 installed thereon. For this purpose, the outer surface 225 of the first portion 222 includes a flat, shallow channel 230 extending from the proximal end (where the first portion 222 joins the second portion 226) to the distal end thereof as perhaps best shown in FIG. 14. The channel 230 is preferably slightly wider and deeper than the width and depth, respectively, of the strap 108 with which the seal 220 is to be used, but it will be appreciated that smaller straps 108 may be utilized without changing the dimensions of the channel 230. One function of the channel 230 is to allow the tag assembly 40 to be coupled to the edge seal 220, with the strap 108 imprisoned in between, without interference from the strap 108. However, it will be appreciated that a channel (not shown) may additionally or alternatively be incorporated into the tag assembly 40, or in some cases the strap 108 may be thin enough that any interference it causes is minimal.

The first portion 222 of the edge seal 220 further includes a pair of retention tabs 231, a tag assembly interface 232, two lock apertures 34, and a box sensor aperture 36. In the illustrated embodiment, the tag assembly interface 232 includes a raised profile that is parallel to the underside surface 23 thereof. More particularly, the interface 232 includes an inwardly-angled surface that effectively forms a recessed groove 233 extending around the sides thereof. In the illustrated embodiment, the groove 233 is an angled groove that may be joined to a corresponding structure on the tag assembly 40, by sliding the tag assembly 40 onto the edge seal 220, to form a secure joint. However, other angled joints, tongue and groove joints, and the like may additionally or alternatively be utilized. Furthermore, the disposition of the joints may be reversed; for example, an inwardly-angled surface may be provided on the tag assembly, and a corresponding structure may be provided on the edge seal.

In the illustrated embodiment, the retention tabs 231 are raised protuberances that extend up into corresponding recesses (described below) in the tag assembly 40 in order to prevent the edge seal 220 from being removed from the strap 108. However, the retention tabs 231 may also help guide a strap 108 into place in the channel 230, guide the tag assembly 40 into place on the edge seal 120, and/or carry out some other function. Further, it will be appreciated that a wide variety of other structures may be utilized.

In the illustrated embodiment, there are two lock apertures 34. The lock apertures 34 and box sensor aperture 36 are arranged to engage corresponding structures or elements on the tag assembly 40. Their use and operation are at least partially described in a separate section.

In at least some embodiments, the seal 220 is held in place on an edge 104 of the box 102 by the tension of the strap 108 around the box and/or by virtue of being clamped around the strap 108. However, the seal 220 may be additionally or alternatively attached to the box 102 by affixing the first and second portions 222,226 of the seal 220 to the adjacent faces 106,107. This may be accomplished, for example, using a pressure-sensitive adhesive (PSA) applied to the underside surfaces 222,227 of the seal, portions of the faces 106,107 of the box 102, or both. By selecting faces 106,107 on either side of an openable edge 104 of the box 102, such edge 104, which would otherwise be openable using conventional methods, becomes sealed against such opening. More particularly, the openable edge 104 may not be opened without compromising the integrity of the box 102, the edge seal 220, or both.

In at least some embodiments, the distal ends 224,228 of the seal portions 222,226 are curved so as to avoid corners that might be more easily pried from the box 102 and/or for some other purpose. However, the curvature may vary from that shown in the drawings, and in some embodiments, shapes having vertices may be employed, particularly if their angles are relatively wide (and thus not sharp).

Except for the areas of the first portion 222 that interact with the tag assembly 40, the contours of the outer surfaces 225,229 of the first and second portions 222,226 may be somewhat less important than the underside surfaces 223, 227 in the sense that they need not been flat, but in at least some embodiments the outer surfaces 225,229 are also flat for the purpose of manufacturing ease and/or some other purpose.

Figure 17:
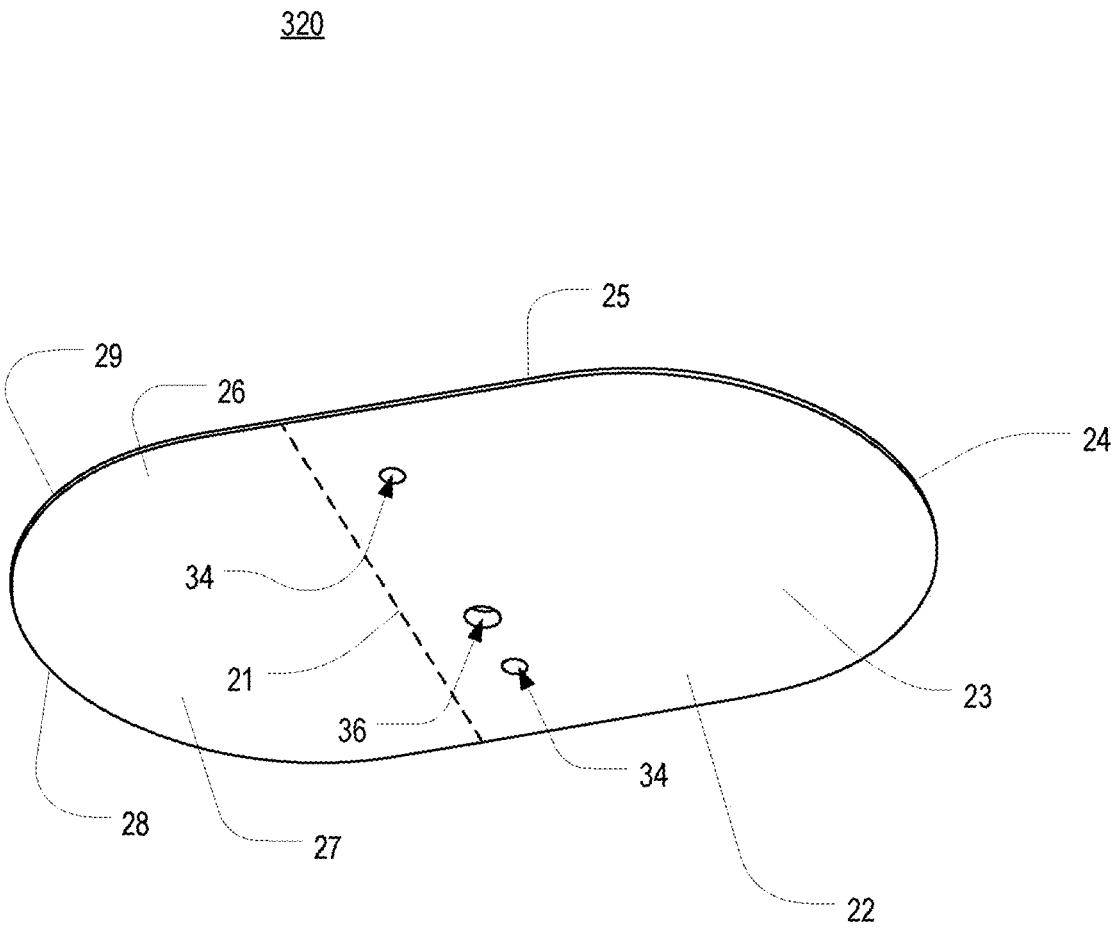
FIG. 17 is an orthogonal view of the underside of an edge seal for use in another alternative box edge security device in accordance with one or more preferred embodiments of the present invention.

FIG. 17 is an orthogonal view of the underside of an edge seal 320 similar to that of FIG. 4, but configured in an initial state. More particularly, the edge seal 320 of FIG. 17 includes a first portion 22 and a second portion 26 that are generally similar to the first and second portions 22,26 of the edge seal 20 of FIGS. 3 and 4, and may have similar edges, apertures, and other characteristics, but the edge seal 320 of FIG. 17 is configured in a flat, planar, or "unfolded" state. The edge seal 320 of FIG. 17 may be bent, creased, folded, or the like along fold line 21 in order to configure the edge seal 320 into a shape akin to that of FIGS. 3 and 4. In fact, in some embodiments, the edge seal 320 of FIG. 17 may be considered to be the same seal as that shown in FIGS. 3 and 4, wherein FIG. 17 illustrates the seal 20 in an unfolded state and FIG. 4 illustrates the seal 20 in a folded state. By providing an edge seal 320 in an unfolded state, a user may bend, crease, fold, or otherwise manipulate the edge seal to fit exactly to a particular box 102. Such box 102 may, for example, have an openable edge 104 whose adjacent faces do not meet at a right angle, in which case the first and second portions 22,26 may not be arranged at right angles to each other when installed on the box 102. Scoring, marking, perforations, and/or other conventional features may be utilized to help a user manipulate the edge seal 320. The edge seals 120,220 of FIGS. 10 and 15 may likewise be provided in such initial state.

Figure 18:
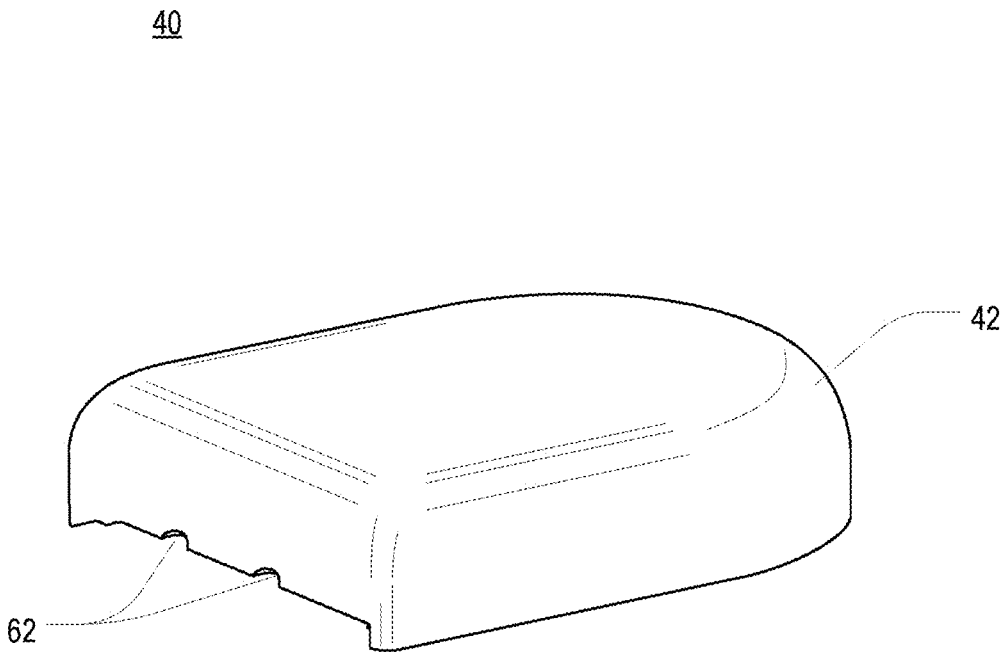
FIG. 18 is an orthogonal view of the tag assembly of FIGS. 1, 6 and 13.
Figure 19:
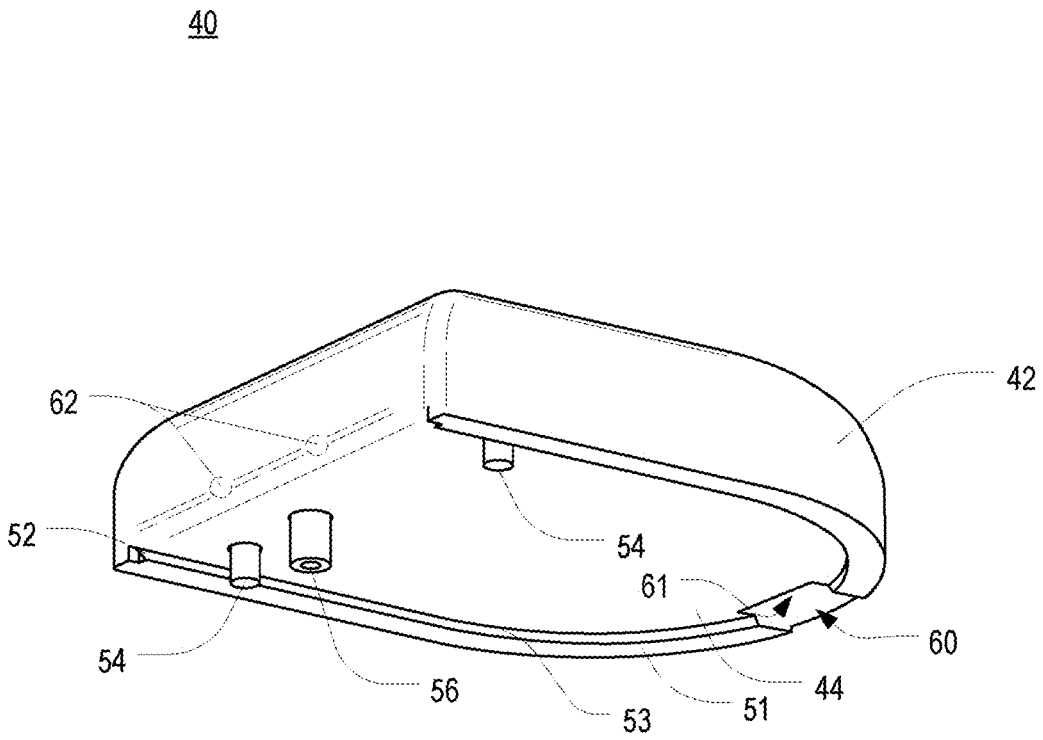
FIG. 19 is an orthogonal view of the underside of the tag assembly of FIG. 18.
Figure 24:
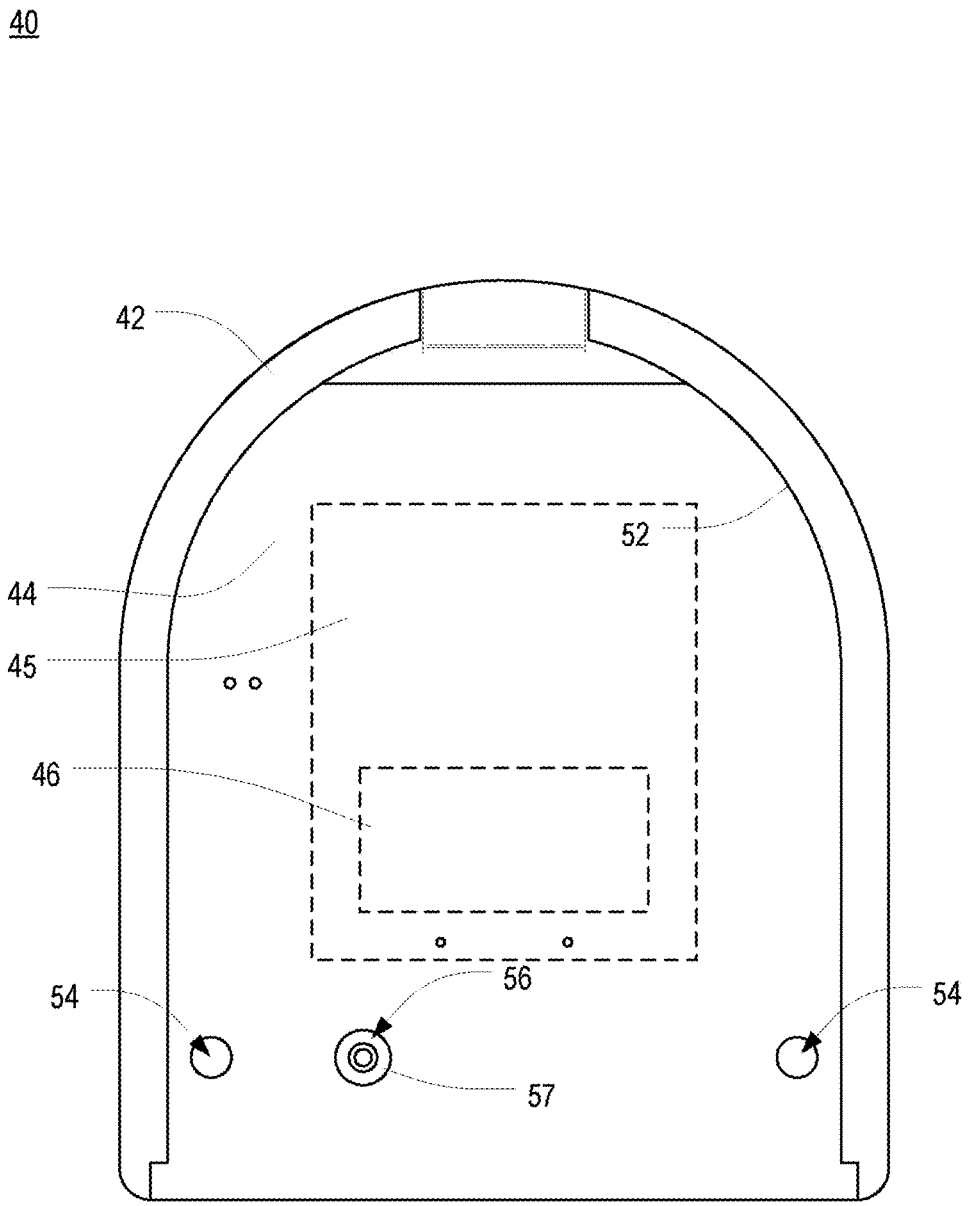
FIG. 24 is a bottom view of the underside of the tag assembly of FIG. 19.

FIG. 18 is an orthogonal view of the tag assembly 40 of FIGS. 1, 6, and 13, while FIG. 19 is an orthogonal view of the underside of the tag assembly 40 of FIG. 18, and FIG. 24 is a bottom view of the underside of the tag assembly 40 of FIG. 19. Among other things, the tag assembly 40 includes a housing 42, a printed circuit board (PCB) 44 supporting an electronics assembly 45, a first seal interface 52, a second seal interface 62, two lock plugs 54, and a box sensor 56.

The first seal interface 52 is located on the underside of the housing 42 and has a recessed profile whose shape and contours correspond to those, for example, of the tag assembly interface 32 on the edge seal 20 of FIGS. 1-5. More particularly, the first seal interface 52 includes a rim 51 and recessed groove 53 extending around the periphery of the underside of the tag assembly 40. In the illustrated embodiment, the groove 53 is an angled groove that may be joined to the corresponding groove 33 in the tag assembly interface 32 of the first illustrated edge seal 20, the angled surface 133 of the second illustrated edge seal 120, and/or the angled surface forming the recessed groove 233 in the third illustrated edge seal 220, by sliding the tag assembly 40 onto the edge seal 20,120,220, to form a secure joint. In this regard, it will be appreciated that the angled surface 133 of the edge seal 120 of FIGS. 6-12 and the angled surface forming the recessed groove 233 in the edge seal 220 of FIGS. 13-16 each have similar dimensions to the groove 33 of the edge seal 20 of FIGS. 1-5. However, other angled joints, tongue and groove joints, and the like may additionally or alternatively be utilized. Furthermore, the disposition of the joints may be reversed; for example, a recessed groove may be provided on the edge seal, and a corresponding structure may be provided on the tag assembly. The corresponding interfaces 32,132,232 and 52 enable the tag assembly 40 to be easily but temporarily coupled to the edge seal 20,120,220 in a way that prevents the two structures 20,120,220 and 40 from being pulled apart by hand once locked in place as described in a separate section.

The second seal interface 62 on the tag assembly 40 includes two recesses on the underside of the housing 42 at its proximal end. The two recesses accommodate the raised protuberances 131 on the edge seal 120 of FIGS. 6-12 and/or the raised protuberances 231 on the edge seal 220 of FIGS. 13-16. When used with one of these edge seals 120,220, a strap 108 extends along the strap channel 130,230 and between the two protuberances 131,231 thereof. With the strap 108 under conventional tension, it would be very difficult to slide the edge seal 120,220 sideways relative to the strap 108 because there would not be enough freedom of movement to force the strap 108 over the protuberances 131,231. However, because the protuberances 131,231 extend up into the recesses 62 on the underside of the tag assembly 40, the difficulty of such manipulation of the seals 120,220 relative to the strap 108 becomes even greater.

For at least a purpose of accommodating a strap 108 without interference when used with one of the edge seals 120,220 of FIGS. 6-12 or FIGS. 13-16, a short, flat channel 60 is provided through the rim 51 on the underside of the tag assembly 40, and a notch 61 may be provided in the PCB 44 or other bottom portion of the housing 42. The channel 60 is preferably slightly wider and deeper than the width and depth, respectively, of the strap 108 with which the seal 120,220 is to be used, but it will be appreciated that smaller straps 108 may be utilized without changing the dimensions of the channel 60. One function of the channel 60, conjunction with the channel 130,230 of the edge seal 120,220, is to allow the tag assembly 40 to be coupled to the edge seal 120,220, with the strap 108 imprisoned in between, without interference from the strap 108. However, it will be appreciated that a deeper channel (not shown) that extends from the distal end of the tag assembly 40 to the proximal end may be utilized such that a shallower channel 130 may be utilized in the edge seal 120,220 or so that no channel is necessary at all in the edge seal 120,220.

In at least some embodiments, the lock plugs 54 include spring-loaded or otherwise biased pins that are movable between an engaged position and a disengaged position. In the engaged position, the lock plugs 54 are positioned to prevent the tag assembly 40 from being moved out of the coupled state, i.e., removed from the edge seal 20. In the disengaged position, the lock plugs 54 are positioned such that they do not interfere with the movement of the tag assembly 40 from the coupled state to a removed state. The lock plugs 54 control whether or not the tag assembly 40 may be slid off of the edge seal 20,120,220 as described previously. The security device 10,110,210 may be further configured such that the lock plugs 54 are biased toward the engaged position. Moreover, with the tag assembly 40 in the coupled state, the security device 10,110,210 may further be configured to prevent the lock plugs 54 from being moved from the engaged position without a specifically configured key. The key may be a magnetic key, coded electronic key, or other conventional key.

The electronics assembly 45 may be contained within the interior of the tag assembly 40. In various preferred embodiments, the electronics assembly 45 includes an EAS tag 46. In the illustrated embodiment, the EAS tag 46 is mounted on the upper surface of the PCB 44, which is attached to the bottom of the housing 42. However, in other embodiments (not shown), the housing 42 includes a top portion and a bottom portion that together enclose the PCB 44 or other EAS tag structure. In some embodiments, the PCB 44 and the housing 42 (or the top housing portion and the bottom housing portion) may be permanently connected, e.g., with an adhesive, weld, one or more fasteners, and/or the like, such that once assembled, the EAS tag is inaccessible to consumers, would-be thieves, and/or the like, while in other embodiments, the PCB 44 may be removed from the housing 42 (or the bottom housing portion may be removed from the top housing portion) when the tag assembly 40 is not attached to an edge seal. The EAS tag is configured to be detectable when the EAS tag is present in a predetermined detection zone located, for example, at or near the door or other entrance point of a retail establishment. The EAS tag may be configured to work within an EAS security system. For example, the EAS tag may a magnetic tag such as in an electromagnetic (EM) system or in an acousto-magnetic (AM) system or an electronic circuit and antenna as in a radio frequency (RF) system. As another example, the EAS tag may be configured work within a microwave system.

In addition to or instead of the EAS tag, the security device 10,110,210 may include other wireless devices. For example, the security device 10,110,210 may include an active or passive RFID tag. The RFID tag may be used to store and/or communicate information about the object for security or inventory control purposes.

The security device 10,110,210 may also be configured with other security or alarm features. For example, the security device 10,110,210 may have an alarm system that includes an audio alarm, such as a piezo-electric siren, or a visual alarm, such as a high-intensity flashing light, that may be triggered in response to one or more circumstances. The alarm system may include a printed circuit board, a light-emitting diode (LED), and a battery, all contained within the tag assembly housing 42. The LED may be in electrical communication with the printed circuit board and the battery and may extend at least partially through an opening in the housing 42 such that at least a portion of the LED is visible outside the housing 42. The LED may be used as an indicator (e.g., by providing a constant light or a blinking on/off light) of the existence of a particular condition or circumstance, e.g., security device 10,110,210 has power, the lock plugs are in the locked position, the alarm is armed, or that the alarm has been triggered.

An alarm of the security device 10,110,210 may be configured to activate in the event that a portion of the edge seal 20,120,220 has been compromised, such as being cut or damaged. For example, the edge seal 20,120,220 may be electrically conductive and form a sense loop in contact with a trigger of the security device. In event that the edge seal 20,120,220 is compromised, the trigger is configured to detect the change in the edge seal 20,120,220 and respond by activating the alarm.

In at least some embodiments, the box sensor 56 includes a spring-loaded or otherwise biased plunger 57 that extends through the box sensor aperture 36. When the tag assembly 10,110,210 is installed on the box 102, the end of the plunger comes into contact with a surface of the box 102 and is pressed inward, arming a portion of the alarm system, and held in such depressed state so long as the tag assembly 10,110,210 remains in place on the box 102. If the tag assembly 10,110,210 is subsequently removed from the box 102 (or if the tag assembly 40 is removed from the edge seal 20,120,220) without first disarming the corresponding portion of the alarm system, then an alarm is triggered. In at least some embodiments, disarming the alarm system may be accomplished using a specifically configured key, such as a magnetic key or a coded electronic key.

The alarm system may additionally or alternatively be configured to excite, and thus activate the alarm, depending on the location of the EAS tag to the gates of the security system. In one embodiment, the alarm system may be configured to trigger an alarm once the EAS tag is near, at, or beyond the gate which should help the employees to detect the merchandise with the attached security device. Therefore, in some embodiments, the security device may have three alarm features, e.g., the gates themselves alarming when the EAS tag is detected, the audible alarm of the security device 10,110,210 itself triggering when it is compromised or otherwise tampered with, and the audible alarm of the security device 10,110,210 triggering when the EAS tag is at, near, or beyond the security gates.

The security device 10,110,210 may also include an impact-resistant feature making it more difficult for a would-be thief to circumvent the locking features of the security device 10,110,210. One skilled in the art would appreciate the other improvements and enhancements that the security device 10,110,210, according to embodiments of the present invention, provides over some of the conventional security devices.

Figure 20:
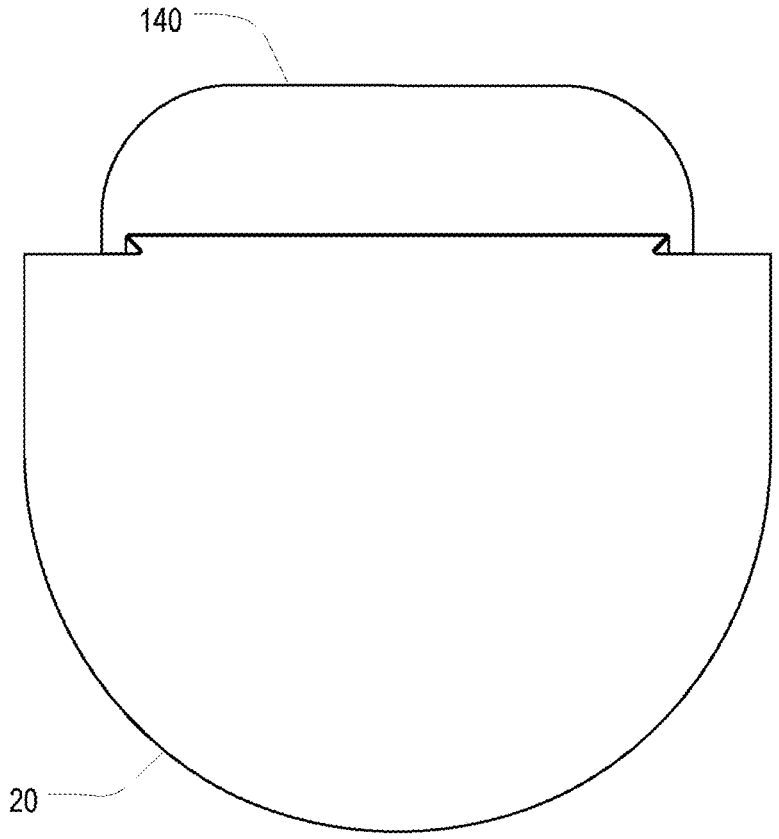
FIG. 20 is a front view of an alternative tag assembly coupled to the edge seal of FIGS. 3 and 4.
Figure 21:
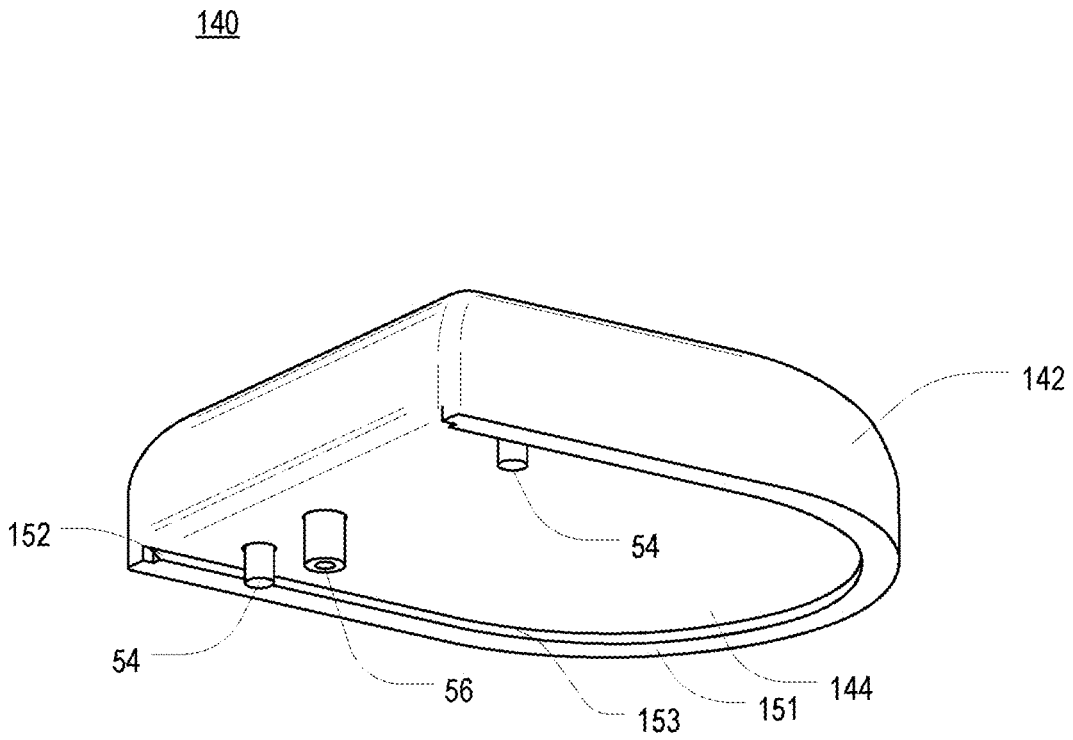
FIG. 21 is an orthogonal view of the underside of the alternative tag assembly of FIG. 20.
Figure 22:
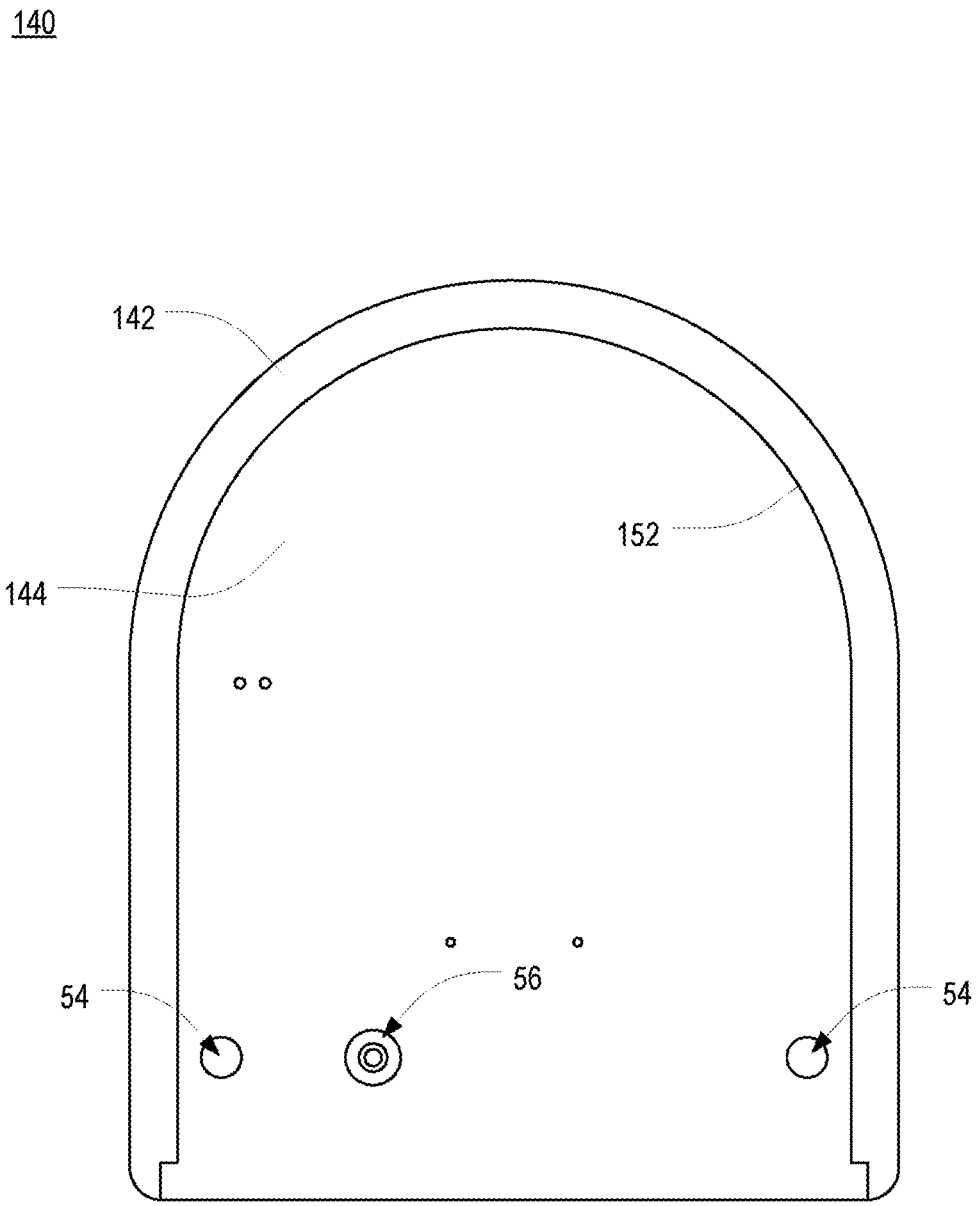
FIG. 22 is a bottom view of the underside of the alternative tag assembly of FIG. 20.
Figure 23:
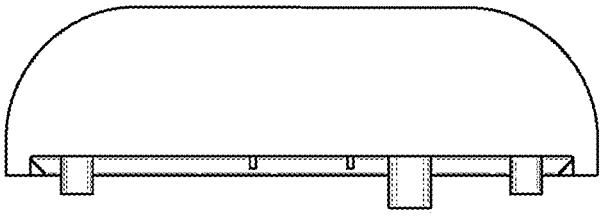
FIG. 23 is a front view of the alternative tag assembly of FIG. 20.

The tag assembly 40 has been described thus far as being usable (and interchangeable) with any of the edge seals 20,120,220. It will be appreciated, however, that tag assemblies may be developed for specific use with only a subset of different edge seals. In this regard, FIG. 20 is a front view of an alternative tag assembly 140 coupled to the edge seal 20 of FIGS. 3 and 4, while FIGS. 21 and 22 are an orthogonal view and a bottom view, respectively, of the underside of the alternative tag assembly 140 of FIG. 20, and FIG. 23 is a front view of the alternative tag assembly 140 of FIG. 20. As shown therein, the tag assembly 140 includes a housing 142, a printed circuit board (PCB) 144 supporting an EAS tag, a seal interface 152, two lock plugs 54, and a box sensor 56, wherein the seal interface 152 includes a rim 151 and recessed groove 153. These elements are generally similar to those of the tag assembly 40 of FIGS. 18 and 19, but the rim 151 does not include any channel 60, and a second seal interface 62 (i.e., recesses) is not provided because the edge seal 20 does not include any protuberances 131 like those of the other edge seals 120,220.

Notably, it will be appreciated that the present invention is embodied in a variety of electronic security devices for merchandise articles, and that although some such devices may include an on-board alarm system that activates in response to various conditions as well as an RFID, transmitter and/or receiver, or other element that can communicate with, or trigger, a transmitter/receiver or other device in the gate or other portion of a security system (such as may be conventionally located at the exit doors of a retail establishment), other electronic security devices may include only a portion of the functionality described herein. For example, in some embodiments, an electronic security device is provided that includes only an alarm that is activated if the edge seal is removed from a box; in some embodiments, an electronic security device is provided that includes only an alarm that is activated if the tag assembly is removed from the edge seal; and in some embodiments, an electronic security device is provided that may only be detected by gates of a security system located at the exit door of a retail establishment. A wide variety of alternative embodiments are likewise possible.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

That which is claimed:

1. A security device comprising:

a seal configured to be attached to a merchandise box, the seal comprising a first structural portion and a seal recessed groove, wherein an underside surface of the first structural portion is disposed on an opposite side of the first structural portion from an outer surface of the first structural portion and the underside surface of the first structural portion is configured to be affixed to a first surface of the merchandise box; and a tag assembly comprising a housing and an electronics assembly disposed within the housing, the housing comprising a tag assembly recessed groove;

wherein the housing of the tag assembly is configured to slide onto the seal via sliding engagement between the tag assembly recessed groove and the seal recessed groove to couple the tag assembly to the seal;

wherein the sliding engagement between the housing of the tag assembly and the seal aligns locking features of the tag assembly and the seal to cause a locked engagement between the housing of the tag assembly and the seal.

2. The security device of claim 1, wherein the electronics assembly comprises an electronic article surveillance (EAS) tag.

3. The security device of claim 1, wherein the seal further comprises a second structural portion arranged at an angle to the first structural portion, the seal being configured to overlay an openable edge of the merchandise box such that an underside surface of the second structural portion is configured to be affixed to a second surface of the merchandise box and the openable edge is disposed between the first surface and the second surface.

4. The security device of claim 3, wherein the angle is a right angle.

5. The security device of claim 1, wherein a pressure-sensitive adhesive (PSA) is disposed on the underside surface of the first structural portion of the seal to affix the seal to the merchandise box.

6. The security device of claim 1, wherein the locking features comprise a lock plug and a lock aperture, the lock plug being biased towards engagement with the lock aperture.

7. The security device of claim 1, wherein the tag assembly includes a box sensor that detects a proximity of a merchandise box to the tag assembly.

8. The security device of claim 1, wherein the tag assembly includes a box sensor, and the box sensor includes a spring-loaded plunger that extends through a plunger aperture in the seal to contact the first surface of the merchandise box.

9. The security device of claim 1, wherein the tag assembly comprises a box sensor, the box sensor comprising a spring-loaded plunger;

wherein the seal comprises a plunger aperture; and wherein the sliding engagement between the housing of the tag assembly and the seal aligns the spring-loaded plunger with the plunger aperture to permit the spring-loaded plunger to pass through the plunger aperture and contact the first surface of the merchandise box to detect a presence of the merchandise box.

10. The security device of claim 1, wherein the tag assembly recessed groove is disposed near a periphery of an underside of the tag assembly.

11. The security device of claim 1, wherein the tag assembly cannot be removed from the seal until the lock plug is disengaged from the seal.

12. The security device of claim 1, wherein outer surface of the first structural portion comprises a channel configured to receive a strap that is arranged around the merchandise box.

13. The security device of claim 1, wherein outer surface of the first structural portion comprises a channel configured to receive a strap and a raised protuberance on each side of the channel that extends into a recess in an underside of the tag assembly to prevent the security device from being moved sideways relative to the strap.

14. The security device of claim 1, wherein the seal is electrically conductive and forms a sense loop that is broken if the seal is removed from the merchandise item.

15. The security device of claim 1, wherein the seal further comprises a second structural portion coupled to the first structural portion;

wherein the seal is initially provided in a flat, unfolded configuration and is bent, folded, creased, or otherwise manipulated to cause the first structural portion to be arranged at an angle to the second structural portion.

16. The security device of claim 1, wherein the electronics assembly includes a user-perceptible alarm, and wherein removal of at least one of the seal and the tag assembly from the merchandise box triggers the alarm.

17. A security device comprising:

a seal configured to be attached to a merchandise box, the seal comprising a seal recessed groove and a plunger aperture; and a tag assembly comprising a housing, an electronics assembly disposed within the housing, and a box sensor;

wherein the housing comprises a tag assembly recessed groove;

wherein the housing of the tag assembly is configured to slide onto the seal via sliding engagement between the tag assembly recessed groove and the seal recessed groove to couple the tag assembly to the seal;

wherein the box sensor comprises a spring-loaded plunger; and wherein the sliding engagement between the housing of the tag assembly and the seal aligns the spring-loaded plunger with the plunger aperture to permit the spring-loaded plunger to pass through the plunger aperture and contact the merchandise box to detect a presence of the merchandise box.

18. A security device comprising:

a seal configured to be attached to a merchandise box, the seal comprising a seal recessed groove; and a tag assembly comprising:

a housing comprising a tag assembly recessed groove; and a communications element, disposed within the housing, configured to wirelessly transmit to a remote device;

wherein the housing of the tag assembly is configured to slide onto the seal via sliding engagement between the tag assembly recessed groove and the seal recessed groove to couple the tag assembly to the seal.

* * * * *